US008399815B2

(12) United States Patent
Akers et al.

(10) Patent No.: US 8,399,815 B2
(45) Date of Patent: Mar. 19, 2013

(54) APPARATUS AND METHOD FOR HARDENING BEARING SURFACES OF A CRANKSHAFT

(75) Inventors: Ronald R. Akers, Guntersville, AL (US); Robert John Madeira, Commerce Township, MI (US); Gary M. Campbell, Albertville, AL (US); Dennis McKinney, Boaz, AL (US); Richard McKelvey, Albertville, AL (US)

(73) Assignee: Ajax Tocco Magnethermic Corporation, Warren, OH (US)

( * ) Notice: Subject to any disclaimer, the term of this patent is extended or adjusted under 35 U.S.C. 154(b) by 1379 days.

(21) Appl. No.: 11/555,789

(22) Filed: Nov. 2, 2006

(65) Prior Publication Data

US 2008/0041844 A1 Feb. 21, 2008

Related U.S. Application Data

(60) Provisional application No. 60/821,412, filed on Aug. 4, 2006.

(51) Int. Cl.
*H05B 6/10* (2006.01)
*H05B 6/22* (2006.01)

(52) U.S. Cl. ..... 219/639; 219/652

(58) Field of Classification Search ..... 219/635, 219/637, 638, 640, 641, 652, 671, 676, 677, 219/650, 655
See application file for complete search history.

(56) References Cited

U.S. PATENT DOCUMENTS 2,834,592 A * 5/1958 Adair et al. ..... 266/117
3,944,446 A 3/1976 Bober
4,123,644 A 10/1978 Sorensen
5,157,231 A 10/1992 Baeuerle et al.
5,333,480 A * 8/1994 Berstein ..... 72/110
5,391,862 A 2/1995 Amateau et al.
5,451,749 A 9/1995 Griebel et al.
5,630,957 A * 5/1997 Adkins et al. ..... 219/665
5,680,693 A 10/1997 Griebel et al.
6,013,904 A 1/2000 Storm et al.
6,018,155 A 1/2000 Storm et al.
6,140,625 A 10/2000 Gezarzick et al.
6,153,865 A 11/2000 Storm et al.
6,160,248 A 12/2000 Ottenwaelder et al.
6,259,076 B1 7/2001 Gezarzick et al.
6,274,857 B1 8/2001 Loveless et al.
6,362,462 B1 3/2002 Merrell et al.
6,399,928 B1 6/2002 Gezarzick et al.
6,455,825 B1 9/2002 Bentley et al.
6,555,800 B1 4/2003 Zahn
6,566,636 B1 5/2003 Bentley et al.
6,638,379 B1 10/2003 Schulte et al.
7,145,115 B2 12/2006 Zahn et al.
7,197,837 B1 * 4/2007 Blanford et al. ..... 33/555.1
2004/0200550 A1 * 10/2004 Pfaffmann et al. ..... 148/526
(Continued)

*Primary Examiner* — Henry Yuen
*Assistant Examiner* — Hung D Nguyen
(74) *Attorney, Agent, or Firm* — Fay Sharpe LLP

(57) ABSTRACT

An apparatus and method for hardening the concentric main bearing surfaces and orbital pin bearing surfaces of a crankshaft for an internal combustion engine. The apparatus includes an inductor that is connected to a high frequency power source with a power controller to cause the power source to direct a given power to the inductor at given rotational heating positions of the crankshaft. A master controller creates output signals to control the power controller. The apparatus and method includes a first multi-surface hardening station with inductors for all of the main bearing surfaces, a second multi-surface hardening station with inductors for some of the orbital pins and a third multi-surface hardening station with inductors for the remaining orbital pins. Total indicator run out (TIR) is measured after the first station to adjust the heating process in the third station to produce a straight crankshaft.

50 Claims, 22 Drawing Sheets

U.S. PATENT DOCUMENTS

2005/0002151 A1 1/2005 Dirnfeldner
2005/0011201 A1* 1/2005 Zurecki et al. ..... 62/64
2005/0081378 A1* 4/2005 Bustamante ..... 29/888.08
2006/0102620 A1 5/2006 Frankfurt

* cited by examiner

| Step # | Position Deg | Inductor 1 Pin 1 Pwr % | Inductor 1 Pin 1 Qnch % | Inductor 1 Pin 1 Ctr Bal % | Inductor 2 Pin 2 Pwr % | Inductor 2 Pin 2 Qnch % | Inductor 2 Pin 2 Ctr Bal % | Inductor 3 Pin 3 Pwr % | Inductor 3 Pin 3 Qnch % | Inductor 3 Pin 3 Ctr Bal % | Inductor 4 Pin 4 Pwr % | Inductor 4 Pin 4 Qnch % | Inductor 4 Pin 4 Ctr Bal % |
|---|---|---|---|---|---|---|---|---|---|---|---|---|---|
| 1 | 0-10 | 40 | 50 | 44 | 55 | 51 | 54 | 65 | 55 | 43 | 60 | 56 | 47 |
| 2 | 10-20 | 40 | 50 | 44 | 55 | 51 | 54 | 65 | 55 | 43 | 60 | 56 | 47 |
| 3 | 20-30 | 40 | 50 | 44 | 35 | 51 | 53 | 65 | 55 | 45 | 60 | 56 | 47 |
| 4 | 30-40 | 40 | 50 | 44 | 40 | 51 | 52 | 65 | 55 | 47 | 60 | 50 | 50 |
| 5 | 40-50 | 40 | 56 | 44 | 40 | 51 | 47 | 65 | 55 | 47 | 60 | 50 | 54 |
| 6 | 50-60 | 35 | 56 | 44 | 40 | 51 | 46 | 65 | 55 | 47 | 60 | 50 | 54 |
| 7 | 60-70 | 35 | 56 | 44 | 40 | 51 | 45 | 65 | 55 | 47 | 60 | 50 | 54 |
| 8 | 70-80 | 35 | 56 | 44 | 40 | 51 | 44 | 65 | 55 | 47 | 60 | 50 | 54 |
| 9 | 80-90 | 65 | 56 | 44 | 40 | 51 | 43 | 65 | 55 | 47 | 40 | 50 | 54 |
| 10 | 90-100 | 65 | 56 | 44 | 40 | 51 | 43 | 65 | 55 | 47 | 35 | 50 | 54 |
| 11 | 100-110 | 65 | 56 | 44 | 40 | 51 | 43 | 65 | 55 | 47 | 35 | 50 | 54 |
| 12 | 110-120 | 65 | 56 | 46 | 40 | 51 | 43 | 65 | 50 | 47 | 35 | 50 | 53 |
| 13 | 120-130 | 65 | 56 | 47 | 40 | 56 | 43 | 65 | 50 | 50 | 40 | 50 | 52 |
| 14 | 130-140 | 65 | 56 | 48 | 40 | 56 | 43 | 65 | 50 | 54 | 40 | 50 | 47 |
| 15 | 140-150 | 65 | 56 | 48 | 35 | 56 | 43 | 65 | 50 | 54 | 40 | 50 | 46 |
| 16 | 150-160 | 65 | 56 | 48 | 35 | 56 | 43 | 65 | 50 | 54 | 40 | 50 | 45 |
| 17 | 160-170 | 65 | 56 | 48 | 35 | 56 | 43 | 65 | 50 | 54 | 40 | 50 | 44 |
| 18 | 170-180 | 65 | 56 | 48 | 65 | 56 | 43 | 44 | 50 | 54 | 40 | 50 | 43 |
| | | | | | | | | | | | | | |
| 19 | 180-190 | 65 | 56 | 48 | 65 | 56 | 43 | 35 | 50 | 54 | 40 | 50 | |
| 20 | 190-200 | 65 | 56 | 48 | 65 | 56 | 43 | 35 | 50 | 54 | 40 | 50 | 45 |
| 21 | 200-210 | 65 | 56 | 48 | 65 | 56 | 45 | 35 | 50 | 53 | 40 | 50 | 46 |
| 22 | 210-220 | 65 | 50 | 48 | 65 | 56 | 46 | 44 | 50 | 52 | 40 | 50 | 46 |
| 23 | 220-230 | 65 | 50 | 51 | 65 | 56 | 47 | 44 | 50 | 47 | 40 | 56 | 46 |
| 24 | 230-240 | 65 | 50 | 55 | 65 | 56 | 47 | 44 | 50 | 46 | 35 | 56 | 46 |
| 25 | 240-250 | 65 | 50 | 55 | 65 | 56 | 47 | 44 | 50 | 45 | 35 | 56 | 46 |
| 26 | 250-260 | 65 | 50 | 55 | 65 | 56 | 47 | 44 | 50 | 44 | 35 | 56 | 46 |
| 27 | 260-270 | 40 | 50 | 55 | 65 | 56 | 47 | 44 | 50 | 43 | 60 | 56 | 46 |
| 28 | 270-280 | 35 | 50 | 56 | 65 | 56 | 47 | 44 | 50 | 43 | 60 | 56 | 46 |
| 29 | 280-290 | 35 | 50 | 55 | 65 | 56 | 47 | 44 | 50 | 43 | 60 | 56 | 46 |
| 30 | 290-300 | 35 | 50 | 54 | 65 | 56 | 47 | 44 | 50 | 43 | 60 | 56 | 48 |
| 31 | 300-310 | 40 | 50 | 53 | 65 | 51 | 47 | 44 | 55 | 43 | 60 | 56 | 47 |
| 32 | 310-320 | 40 | 50 | 48 | 65 | 51 | 50 | 44 | 55 | 43 | 60 | 56 | 47 |
| 33 | 320-330 | 40 | 50 | 47 | 65 | 51 | 54 | 35 | 55 | 43 | 60 | 56 | 47 |
| 34 | 330-340 | 40 | 50 | 46 | 65 | 51 | 54 | 35 | 55 | 43 | 6 | 56 | 47 |
| 35 | 340-350 | 40 | 50 | 45 | 65 | 51 | 54 | 35 | 55 | 43 | 60 | 56 | 47 |
| 36 | 350-360 | 40 | 50 | 44 | 40 | 51 | 54 | 65 | 55 | 43 | 60 | 56 | 47 |

FIG. 35

| | | Inductor 1 | | | Inductor 2 | | | Inductor 3 | | | Inductor 4 | | | Inductor 5 | | |
|---|---|---|---|---|---|---|---|---|---|---|---|---|---|---|---|---|
| | | Main 1 | | Ctr | Main 2 | | Ctr | Main 3 | | Ctr | Main 4 | | Ctr | Main 5 | | Ctr |
| Step | Position | Pwr | Qnch | Bal | Pwr | Qnch | Bal | Pwr | Qnch | Bal | Pwr | Qnch | Bal | Pwr | Qnch | Bal |
| # | Deg | % | % | % | % | % | % | % | % | % | % | % | % | % | % | % |
| 1 | 0-10 | 39 | 35 | 34 | 56 | 44 | 34 | 60 | 37 | 35 | 56 | 36 | 34 | 38.5 | 42 | 34 |
| 2 | 10-20 | 39 | 35 | 34 | 56 | 37 | 34 | 60 | 37 | 35 | 56 | 36 | 34 | 38.5 | 42 | 34 |
| 3 | 20-30 | 39 | 35 | 34 | 56 | 37 | 34 | 60 | 37 | 35 | 56 | 36 | 34 | 38.5 | 42 | 34 |
| 4 | 30-40 | 39 | 35 | 34 | 56 | 37 | 34 | 60 | 37 | 35 | 56 | 36 | 34 | 38.5 | 42 | 34 |
| 5 | 40-50 | 39 | 35 | 34 | 56 | 37 | 34 | 60 | 37 | 35 | 56 | 36 | 34 | 26 | 42 | 34 |
| 6 | 50-60 | 39 | 35 | 34 | 56 | 37 | 34 | 60 | 37 | 35 | 56 | 36 | 34 | 26 | 42 | 34 |
| 7 | 60-70 | 39 | 35 | 34 | 56 | 37 | 34 | 60 | 37 | 35 | 56 | 36 | 34 | 38.5 | 42 | 34 |
| 8 | 70-80 | 39 | 35 | 34 | 56 | 37 | 34 | 60 | 37 | 35 | 56 | 45 | 34 | 38.5 | 42 | 34 |
| 9 | 80-90 | 39 | 35 | 34 | 56 | 37 | 34 | 60 | 37 | 35 | 56 | 45 | 34 | 38.5 | 42 | 34 |
| 10 | 90-100 | 39 | 35 | 34 | 56 | 37 | 34 | 60 | 37 | 35 | 56 | 45 | 34 | 38.5 | 42 | 34 |
| 11 | 100-110 | 39 | 35 | 34 | 56 | 37 | 34 | 60 | 37 | 35 | 56 | 45 | 34 | 38.5 | 42 | 34 |
| 12 | 110-120 | 39 | 35 | 34 | 56 | 37 | 34 | 60 | 37 | 35 | 56 | 45 | 34 | 38.5 | 42 | 34 |
| 13 | 120-130 | 39 | 35 | 34 | 56 | 37 | 34 | 60 | 37 | 35 | 56 | 45 | 34 | 38.5 | 42 | 34 |
| 14 | 130-140 | 39 | 35 | 34 | 56 | 37 | 34 | 60 | 37 | 35 | 56 | 45 | 34 | 38.5 | 42 | 34 |
| 15 | 140-150 | 39 | 35 | 34 | 56 | 37 | 34 | 60 | 37 | 35 | 56 | 45 | 34 | 38.5 | 42 | 34 |
| 16 | 150-160 | 39 | 35 | 34 | 56 | 37 | 34 | 60 | 37 | 35 | 56 | 45 | 34 | 38.5 | 42 | 34 |
| 17 | 160-170 | 39 | 35 | 34 | 56 | 37 | 34 | 60 | 37 | 35 | 56 | 45 | 34 | 38.5 | 42 | 34 |
| 18 | 170-180 | 39 | 35 | 34 | 56 | 37 | 34 | 60 | 37 | 35 | 56 | 45 | 34 | 38.5 | 42 | 34 |
| 19 | 180-190 | 39 | 35 | 34 | 56 | 37 | 34 | 60 | 37 | 35 | 56 | 45 | 34 | 38.5 | 42 | 34 |
| 20 | 190-200 | 39 | 35 | 34 | 56 | 37 | 34 | 60 | 37 | 35 | 56 | 36 | 34 | 38.5 | 42 | 34 |
| 21 | 200-210 | 39 | 35 | 34 | 56 | 37 | 34 | 60 | 37 | 35 | 56 | 36 | 34 | 38.5 | 42 | 34 |
| 22 | 210-220 | 39 | 35 | 34 | 56 | 37 | 34 | 60 | 37 | 35 | 56 | 36 | 34 | 38.5 | 42 | 34 |
| 23 | 220-230 | 39 | 35 | 34 | 56 | 37 | 34 | 60 | 37 | 35 | 56 | 36 | 34 | 23 | 42 | 34 |
| 24 | 230-240 | 39 | 35 | 34 | 56 | 37 | 34 | 60 | 37 | 35 | 56 | 36 | 34 | 23 | 42 | 34 |
| 25 | 240-250 | 39 | 35 | 34 | 56 | 37 | 34 | 60 | 37 | 35 | 56 | 36 | 34 | 23 | 42 | 34 |
| 26 | 250-260 | 39 | 35 | 34 | 56 | 37 | 34 | 60 | 37 | 35 | 56 | 36 | 34 | 38.5 | 42 | 34 |
| 27 | 260-270 | 39 | 35 | 34 | 56 | 37 | 34 | 60 | 37 | 35 | 56 | 36 | 34 | 38.5 | 42 | 34 |
| 28 | 270-280 | 39 | 35 | 34 | 56 | 37 | 34 | 60 | 37 | 35 | 56 | 36 | 34 | 38.5 | 42 | 34 |
| 29 | 280-290 | 39 | 35 | 34 | 56 | 44 | 34 | 60 | 37 | 35 | 56 | 36 | 34 | 38.5 | 42 | 34 |
| 30 | 290-300 | 39 | 35 | 34 | 56 | 44 | 34 | 60 | 37 | 35 | 56 | 36 | 34 | 38.5 | 42 | 34 |
| 31 | 300-310 | 39 | 35 | 34 | 56 | 44 | 34 | 60 | 37 | 35 | 56 | 6 | 34 | 38.5 | 42 | 34 |
| 32 | 310-320 | 39 | 35 | 34 | 56 | 44 | 34 | 60 | 37 | 35 | 56 | 36 | 34 | 38.5 | 42 | 34 |
| 33 | 320-330 | 39 | 35 | 34 | 56 | 44 | 34 | 60 | 37 | 35 | 56 | 36 | 34 | 38.5 | 42 | 34 |
| 34 | 330-340 | 39 | 35 | 34 | 56 | 44 | 34 | 60 | 37 | 35 | 56 | 36 | 34 | 38.5 | 42 | 34 |
| 35 | 340-350 | 39 | 35 | 34 | 56 | 44 | 34 | 60 | 37 | 35 | 56 | 36 | 34 | 38.5 | 42 | 34 |
| 36 | 350-360 | 39 | 35 | 34 | 56 | 44 | 34 | 60 | 37 | 35 | 56 | 36 | 34 | 38.5 | 42 | 34 |

FIG. 36

APPARATUS AND METHOD FOR HARDENING BEARING SURFACES OF A CRANKSHAFT

REFERENCE TO RELATED APPLICATION

This application claims priority to and the benefit of U.S. Provisional Patent Application Ser. No. 60/821,412, filed Aug. 4, 2006, entitled APPARATUS AND METHOD FOR HARDENING BEARING SURFACES OF A CRANKSHAFT, the entirety of which is hereby incorporated by reference.

FIELD OF INVENTION

The invention relates to the art of induction heating and quench hardening rotating bearing surfaces and more particularly to an apparatus and method for hardening the cylindrical bearing surfaces spaced axially along a crankshaft of the type used in an internal combustion engine. Bearing surfaces include the terminal fillets.

INCORPORATION BY REFERENCE

Induction heating for quench hardening the cylindrical bearing surfaces of a rotating crankshaft was pioneered by Park Ohio Industries many years ago. Now this technology is well developed and is the subject of many patents constituting background information to the present invention. Representative background technology is disclosed in Sorensen U.S. Pat. No. 4,123,644. An inductor for use in such an apparatus is described in Griebel U.S. Pat. No. 5,451,749. These two patents owned by assignee of the present application are incorporated by reference. Indeed, the inductor shown in Griebel U.S. Pat. No. 5,451,749 is generally the same type inductor as used in the apparatus and method of the present invention. Consequently, the inductor structure need not be described in further detail for understanding the induction heating and hardening concept of the invention. Other representative patents incorporated by reference herein are Storm U.S. Pat. No. 6,013,904; Loveless U.S. Pat. No. 6,274,857; Zahn U.S. Pat. No. 6,555,800; and, Schulte U.S. Pat. No. 6,638,379. The Schulte patent discloses an apparatus and method for inductively heating and then quench hardening a crankshaft of the type processed by the present invention; however, this patent is merely prior art of the type improved by the present invention. In this prior art patent, the distortion or total indicator run out (TIR) of the crankshaft is reduced by inductively heating and quench hardening the main bearings of the crankshaft after the orbiting pin bearing surfaces have been hardened. This procedure sequence has not proven satisfactory and requires substantial bending of the crankshaft after it is hardened, in an effort to reduce the TIR. Indeed, shaft distortion is usually corrected after hardening. This drastically reduces the strength of the crankshaft and increases the processing cost associated with the apparatus and method for hardening the axially spaced bearing surfaces.

THE INVENTION

The present invention recognizes the advantage of first inductively heating and quench hardening the main bearings, after which the orbital pin bearings are processed by first hardening one group of pin bearings and then hardening another group of pin bearings. Consequently, the apparatus and method of the present invention essentially inductively heats and quench hardens the main bearings and, then, inductively heats and quench hardens the two center orbital pin surfaces. A final station is used to inductively heat and quench harden the two outside orbital pin bearings. Hardening of one group of pin bearing causes distortion (TIR) in one direction and hardening of the next group causes a corrective distortion in the opposite direction. The pins in each group may vary when processing different crankshafts. By using the present invention, total indicator run out (TIR) of the main bearings after the whole crankshaft has been processed is less than 0.020 inches and preferably less than 0.015 inches. There is no need for successive straightening of the processed crankshaft.

This unique sequencing of the hardening procedure results in a straight crankshaft without subsequent straightening. Furthermore, the heating and quenching of each of the cylindrical bearing surfaces of a crankshaft is performed by a combination of a specific heating profile and a quenching procedure that produces an automatic tempering in the preferred embodiment. Automatic tempering is accomplished by quenching the surfaces to leave a controlled amount of heat energy to temper the hardened surfaces.

The second and fourth main bearing surfaces and all the pin surfaces employ a pulse quenching procedure where the amount of quenching liquid is controlled at arcuate increments of crankshaft rotation. In practicing the invention, the apparatus and method is created and adjusted by testing the metallurgy of the bearing surfaces. Then the heating profile is interactively modified until the desired metallurgical properties are obtained around the bearing surface. In accordance with this aspect of the invention, the heat profile for the bearing surfaces is interactively adjusted in a closed loop fashion at each of a small arcuate increment, in practice 10 degrees. The metallurgical characteristics of the surface are again tested and the heat profile is modified to provide a final profile having the desired metallurgical characteristics. In this fashion, the final heat profile use for production compensates for the power lag during the induction heating cycle of each cylindrical bearing surface. The final constructed profile is used to provide power at each arcuate increment. Another aspect of the invention is use of a pulsating quench for the bearing surfaces associated with the orbiting pins of the crankshaft. The pulsating quenching is preceded by a full quench flow to reduce the temperature of the rotating pin surface preparatory to pulse quenching to a temperature allowing automatic tempering of the heated, hardened surfaces. The heating profile that is constructed for production run of the pins changes the amount of heating of the pins when the heating is at top dead center or at bottom dead center. The unique combination of use of a constructed power profile and pulse quenching is employed to produce the desired metallurgical characteristics of the several axially spaced pins on the crankshaft. This set-up is then used for the production run of the apparatus for hardening the bearing surfaces. Thus, this unique procedure for hardening the pins utilizing a constructed heat profile and a pulsed quenching procedure to leave a certain amount of heat energy. Then a soaking operation provides the desired tempered metallurgical characteristics. At the same time, the sequence for processing the bearing surfaces results in a relatively straight crankshaft requiring no subsequent straightening operation.

The term "cylindrical surface" used to describe the invention includes the fillets on axial ends of the actual surfaces. Thus, the surfaces and associated fillets are hardened by using the present invention.

In accordance with the primary aspect of the invention, there is provided an apparatus for hardening the concentric main bearing surfaces and the orbiting pin bearing surfaces of a crankshaft for an internal combustion engine. The apparatus comprises a somewhat standard inductor for encircling each of the surfaces to be hardened over at least a portion of the surface, preferably over substantially less than 180 degrees of the surface, and riding on the surface to maintain an induction heating gap. Such inductor is shown in Griebel U.S. Pat. No. 5,451,749. The inductor is connected to a high frequency power source having a power controller to cause the power source to direct a given power to the inductor. The power is controlled at the different rotational positions of the crankshaft. Furthermore, the inductor includes a quench chamber or quenching head with outlet orifices directing quenching liquid toward the surface encircled by the inductor. A supply of quenching liquid with a flow controller is used to direct a given quantity of quench liquid to the chamber and through the orifices against the surface after the surface has been heated by the inductor using the constructed heat profile. The amount of quenching liquid is controlled at different rotational positions of the crankshaft during the quenching cycle. The heat profile is performed repeatedly over each 360 degrees of rotation, whereas the quench flow is controlled at arcuate increments during the total quench cycle A counter balancing mechanism is employed with a counter balanced controller to control the riding force of the inductor against a surface encircled by the inductor. This is important when heating or quenching a pin surface. When processing a main surface the counter balance does not vary. A master controller is used for creating output signals to control the level of power by the power controller (to follow the constructed profile) and the amount of liquid flow by the flow controller for each of the surfaces encircled by the inductor. The power and quench flow is controlled at rotational positions in arcuate increments of less than 30 degrees and more particularly less than 20 degrees. In practice the increments are about 10 degrees. In summary, the power level is controlled during each arcuate increment which is less than 30 degrees and preferably about 10 degrees. The liquid flow during the quench hardening cycle is also changed by a flow controller operated in accordance with signals created at each of the arcuate increments. In accordance with another feature, at each of the arcuate increments the master controller creates signals for controlling the counter balancing for each of the surfaces. The force of the inductor riding against the rotating surface is in the range of 15-30 pounds.

A primary aspect of the invention is to heat and then quench the cylindrical surface and fillets while leaving sufficient heat energy to allow automatic tempering of the surface and its fillets.

In accordance with another aspect of the invention, the quenching of the inner main bearings and each of the pin bearings involves a pulsed flow of quenching liquid. For the pin bearings, the quenching cycle is divided into a continuous flow portion and a pulsed flow portion. The pulsed flow is coordinated with the top dead center and bottom dead center of the orbiting pin surfaces. Both the main bearing surfaces and the pin bearing surfaces are not fully quenched. Residual heat energy in the quenched bearing surfaces allows tempering of the hardened surfaces without requirement of a subsequent tempering operation.

In accordance with still a further aspect of the present invention, the sequence of hardening the various cylindrical bearing surfaces is unique. In general, the invention provides for controlled sequencing and adaptation of hardening of multiple bearing sets such that the hardening process for one bearing set compensates for, or counteracts, distortion caused by hardening of an earlier set, where the sets can be one or more bearings, and either set can include main bearings, pin bearings, or both. The controlled sequencing aspects of the invention may be successfully employed to control or limit final distortion of the crankshaft after all bearing surfaces have been hardened. In one possible implementation, a first station inductively heats and quench hardens the main bearing surfaces. This procedure provides a given total indicator run out in a known first direction. A second station is then used to inductively heat and quench harden certain pin bearings, such as pins 2 and 3. This procedure has a known, previously determined distortion in the same direction as the main bearing surfaces, where the distortions caused by the main bearing hardening and the hardening of the first set of pin bearings can be determined in any suitable manner, such as through empirical experiments, measurements of a continuing process, SPC, SQC, or other data gathering technique, or through design calculations or combinations thereof. In this example, a third station is used to harden a second set of pins, such as pins 1 and 4, in a manner to provide run out in the direction opposite to the determined run out of the first two stations. Thus, the hardening procedure for pins 1 and 4 counteract distortion caused by the hardening of the main bearings and the surfaces of pins 2 and 3. This action drives the crankshaft toward a straight position with a total indicator run out within a preset level, such as less than 0.020 and preferably less than 0.015 inches. Distortions at the first and second stations are in the same direction, while the distortion in the third station is in the opposite direction. This action eliminates the necessity for subsequent straightening of the crankshaft as shown in Shult U.S. Pat. No. 6,638,379. This compensatory effect of the final hardening can be accomplished through selection of the constituent bearings hardened in each station, alone or in combination with adaptive adjustment of the later hardening process based on an intervening TIR measurement of the initial distortion in the first direction. In one embodiment, measurement of the total indicator read-out after the second station allows the heating profile for use on the third station to be adjusted to bring the total run out of the crankshaft into the desired specification.

Still a further aspect of the present invention is the provision of an apparatus for hardening the orbital pin bearing surfaces of a crankshaft for an internal combustion engine. This apparatus has an orbital inductor to heat the pins, an orbital quench head with a supply of quenching liquid having a flow controller to direct a given quantity of quench liquid to the head and against the heated pin surface and a device for controlling the flow controller during a rotational quenching cycle. The quenching flow is generally continuous for at least 360 degrees rotation of the crankshaft and then is pulsed to harden the surface while leaving sufficient internal heat for slight tempering of the hardened surface. This automatic tempering is determined by a diagnostic procedure before the production run of a given crankshaft is started.

Yet another aspect of the present invention is the provision of an apparatus for hardening the orbital, successive pin bearing surfaces 1, 2, 3 and 4 of a crankshaft for an internal combustion engine. The crankshaft has previously hardened main bearing surfaces. The novel apparatus includes a mechanism for measuring the TIR of the main bearing surfaces after a first group of the pin surfaces is hardened, a circuit for determining the relationship of the measured TIR and a desired value of TIR and then a circuit for adjusting the heating power for the second group of pins to move the TIR toward the desired value. In this aspect of the invention, the desired TIR is less than 0.015 inches, the first group of pins comprises pins 2 and 3 and the second group of pins comprises pins 1 and 4.

Yet another aspect of the invention is the provision of an apparatus for inductively heating and quench hardening the bearing surfaces of a crankshaft for an internal combustion engine. The apparatus includes a memory device with a data table indexed during each arcuate increment of rotation of the crankshaft. The data table contains a series of output signals for the heating power for the heating cycle for each of the surfaces. The series of signals over the cycle defines a heating profile. A device indexes the table each arcuate increment of the crankshaft rotation. The arcuate increments are less than 30 degrees and more particularly less than 20 degrees. In practice the increments are about 10 degrees.

Still a further aspect of the present invention is the provision of a method for hardening the concentric main bearing surfaces and orbital pin bearing surfaces of a crankshaft for an internal combustion engine rotatable about a common center axis of the main bearing surfaces. This method involves encircling each one of the surfaces to be hardened with an inductor, preferably extending over substantially less than 180 degrees of the surface, and riding on the surface, connecting the inductor to a high frequency power source with a power controller to cause the power source to direct a given power to the inductor at given rotational heating positions of the crankshaft, providing a quench head to direct liquid toward the surface encircled by the inductor, controlling the flow of a quenching liquid to the head after the surface has been heated by the inductor, counter balancing the inductor for controlling the riding force of the inductor against the surface encircled by the inductor and controlling the power controller and the flow controller for each of the surfaces encircled by the inductor and at rotatable positions in arcuate increments of less than 30 degrees. This method is further practiced by controlling the counter balancing for each inductor at the same rotational increments. The counter balancing provides a riding force in the general range of 15-30 pounds. At the inductors for the pin bearing surfaces the quench flow is continuous over a given number of rotational increments amounting to at least 360 degrees of rotation of the crankshaft and then is pulsed to complete the quenching cycle.

Another aspect of the present invention is the provision of a method for hardening the concentric main bearing surfaces and orbital pin surfaces of a crankshaft for an internal combustion engine. The method comprises providing a first multi-surface hardening station, simultaneously induction heating of the main bearing surfaces in the first station, and then quench hardening all of the main bearing surfaces simultaneously. A second multi-surface hardening station is used for inductively heating and quench hardening pins 2 and 3, while a third multi-surface hardening station is used for inductively and quench hardening pins 1 and 4. In this manner, the natural shift of TIR during the first two stations is overcome by adjusting the heat for hardening of pins 1 and 4 in the third processing station.

Yet another aspect of the invention is a method for hardening the orbital pin bearing surfaces of a crankshaft for an internal combustion engine. The method comprises providing an orbital inductor to heat each of the pins, providing an orbital quenching head with a supply of quenching liquid with a controller to direct flow with a given quantity of quench liquid to the head and against the heated pin surface and controlling the flow during a quenching cycle. The quenching cycle involves generally continuous liquid flow for at least 360 degrees rotation of the crankshaft and then pulsed flow to harden the surface. Sufficient internal heat is retained for slight tempering of the hardened surface.

Another aspect of the present invention is a method for hardening orbital successive pin bearing surfaces 1, 2, 3 and 4 of a crankshaft for an internal combustion engine, the crankshaft having hardened main bearing surfaces. The method includes measuring the TIR of the main bearing surfaces after a first group of the pin surfaces are hardened, determining the relationship of the measured TIR and a desired value of TIR and then adjusting the heating power for the second group of pins to move the TIR toward the desired value. The first group of pins comprises pins 2 and 3 whereas the second group of pins comprises pins 1 and 4.

Still a further aspect of the present invention is a method for inductively heating and quench hardening the bearing surfaces of a crankshaft for an internal combustion engine. The method includes providing a memory device with a data table indexed during each arcuate increment of rotation of the crankshaft, wherein the data table contains a series of output signals for the heating power for the heating cycle of each surface. The series of signals over the heating cycle defines a heating profile for each rotation of the bearing surface. The method involves indexing the table each arcuate segment of the crankshaft rotation. Furthermore, the method includes changing the profile based upon the final tempered hardness of the surface over the heating cycle before the profile is used for the final production run.

Still a further aspect of the invention is the provision of an apparatus for hardening the concentric main bearing surfaces and orbital pin bearing surfaces of a crankshaft for an internal combustion engine, which apparatus comprises an inductor for encircling each one of the surfaces to be hardened over substantially less than a 180° of the surface and riding on the surface. The inductors are connected to a high frequency power source with a power controller to cause the power source to direct a given power to the inductor. A supply of quenching liquid is provide with a flow controller to direct a given quantity of quench liquid against the surface after the surface has been heated by the inductor. A counter balancing mechanism, with a counter balanced controller, is used for controlling the riding force of the inductor against the encircling inductor. A master controller MC causes the power source 100 to continuously heat main bearing surfaces 1, 3 and 5 and pulse heat main bearing surfaces 2 and 4.

A broad aspect of the present invention is the provision of an apparatus for hardening the cylindrical surface of a pin bearing of a crankshaft, which apparatus comprises means for developing a heat cycle profile with power levels at arcuate increments, an inductor for encircling the surface, preferably over substantially less than 180 degrees of the surface, a high frequency power source with a controller to implement the profile repeatedly during the successive rotations of the crankshaft to heat the surface. A quench head is used for directing quenching liquid against the surface after it has been heated. The quench head has a flow controller for directing quenching liquid through the head in a first continuous flow and then in a pulsed flow to quench the heated surface. This is accomplished in a manner to leave sufficient heat energy to automatically temper the surfaces and, thus, the associated fillets to a desired metallurgical condition around the pins.

Another broad aspect of the invention is related to hardening techniques for crankshaft bearing surfaces, including induction hardening a first bearing, which can be a pin bearing or a main bearing, using a first power profile, and measuring a crankshaft TIR after induction hardening the first bearing. The method further includes determining a second power profile at least partially according to the measured crankshaft TIR, and induction hardening a second bearing, whether a pin or main bearing, using the second power profile.

The invention is applicable to crank shafts of configurations different from the crankshaft shown in FIG. 1, such as a crankshaft for a V6, V10 or V12 internal combustion engine. It can be used with crank shafts for straight engines, such as 3, 4, 5, 6, 8, 10 and 12 cylinder engines. The disclosed sequence may change, but the apparatus and method concepts for determining the optimum sequence is still appropriate.

The primary object of the present invention is the provision of an apparatus and method for hardening the axially spaced bearings of a crankshaft, which apparatus and method produces a crankshaft with a low TIR without subsequent processing.

Another object of the present invention is the provision of an apparatus and method, as defined above, which apparatus and method is controlled to produce the desired metallurgical characteristics around the cylindrical bearing surfaces utilizing an automatic tempering procedure instead of a subsequent tempering operation.

Still a further object of the present invention is the provision of an apparatus and method, as defined above, which apparatus and method adjust the heat during short arcuate increments. The same short arcuate increments are sensed and then used to adjust the quenching flow and/or the counter balancing position or force. In practice, the arcuate increments are less than 20 degrees and are preferably about 10 degrees. In this manner, the lag time of the power source can be identified and compensated for by changing the arcuate position of the defined heating profile before the profile is used for the production run.

Another object of the invention is an apparatus and method of induction heating and quench hardening the surfaces of the bearing of various crank shafts by controlling the heating and quenching at arcuate increments of less than 30 degrees and preferably less than 20 degrees. In practice the increments are about 10 degrees.

These and other objects and advantages will become apparent from the following description taken together with the accompanying drawings.

BRIEF DESCRIPTION OF DRAWINGS

FIG. 35 is a table with the control signal levels for power, quench and counter balance for the pin bearings at different arcuate increments;

FIG. 36 is a table similar to the table of FIG. 36 for the main bearing surfaces of the crankshaft hardened in accordance with the present invention; and, FIG. 37 is a schematic block diagram illustrating the use of data tables created by the diagnostic procedure set forth in FIG. 26.

PREFERRED EMBODIMENT

Figure 1:
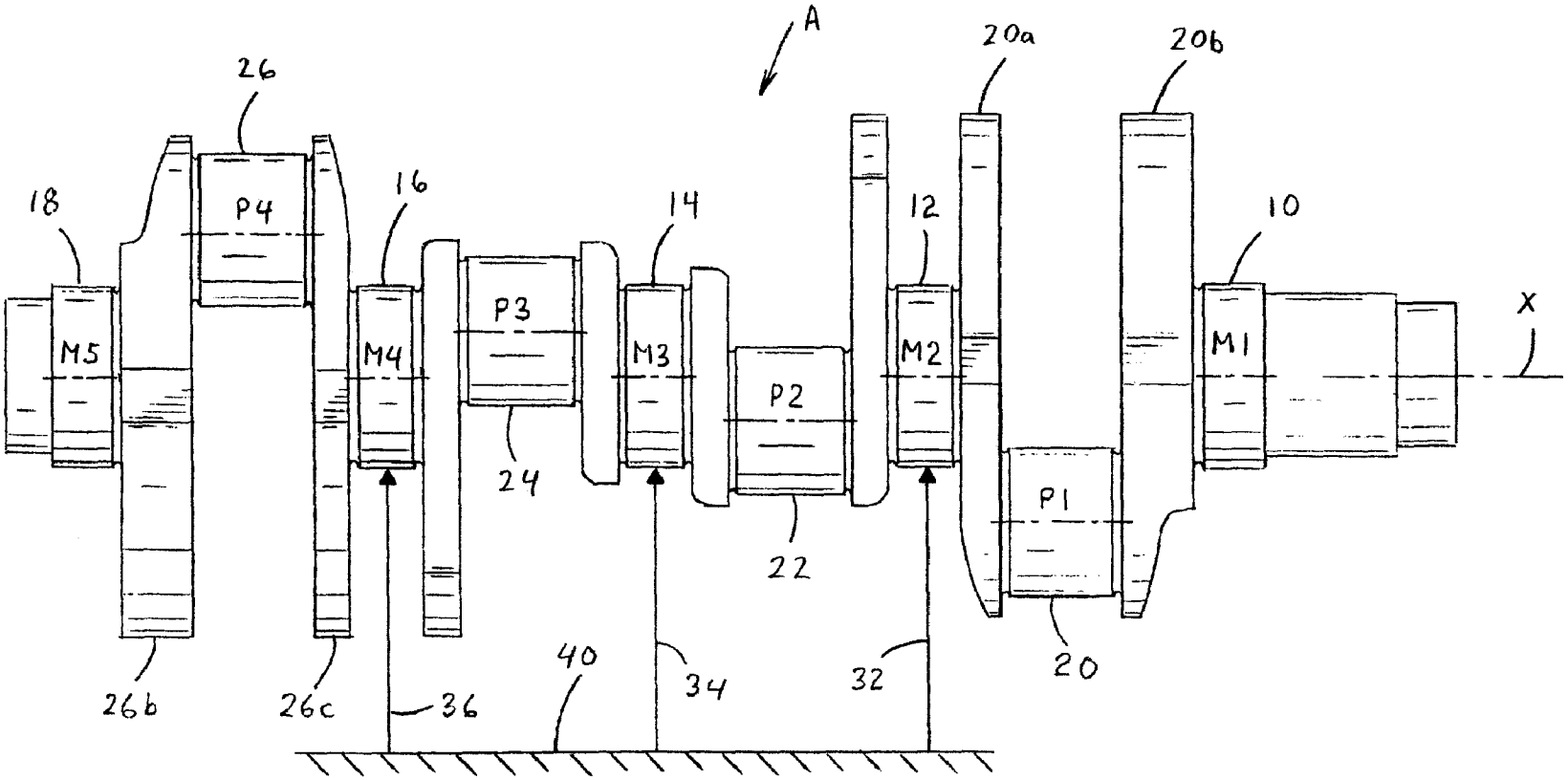
FIG. 1 is a side elevational view of a crankshaft for an 8 cylinder internal combustion engine with the main bearings and orbital pin bearings identified.

The present invention relates to an apparatus and method for hardening the axially spaced bearing surfaces of a crankshaft for a multi-cylinder internal combustion engine, such as crankshaft A for an eight cylinder engine as shown in FIG. 1.

The bearing surface means the cylindrical surface and fillets. When cylindrical surface or bearing surface is used it incorporates the adjacent fillets.

While the following embodiments are illustrated and described in the context of induction hardening the exemplary crankshaft A having 5 main and 4 interspersed pin bearings, the invention finds utility in association with induction hardening of any type of crankshaft having any number of pin and main bearings, wherein the invention is not limited to the illustrated embodiments. Moreover, the invention contemplates hardening of individual bearings or groups of bearings, which can be accomplished using two or more such sets, and the broad aspects of the invention are not limited to the number of groups in the illustrated examples, or the constituent members of the exemplary groups or sets described herein.

In the illustrated examples, the crankshaft bearing surfaces are inductively heated and then quench hardened with the objective of providing a straight, undistorted crankshaft with metallurgical characteristics for the individual cylindrical bearing surfaces constituting a tempered hardness. Representative crankshaft A includes axially spaced, cylindrical bearing surfaces 10, 12, 14, 16 and 18 for concentric main bearings M1, M2, M3, M4 and M5 and coaxial with axis x of the crankshaft. In accordance with standard design, shaft A includes cylindrical bearing surfaces 20, 22, 24 and 26 for pin bearings P1, P2, P3 and P4, respectively. The pin bearing surfaces orbit about axis x as shaft A is rotated during induction heating, quench hardening and automatic tempering of each of the individual bearing surfaces. As will be explained later, the main bearing surfaces are hardened in a first station. In this first station the inner main bearings M2, M3, M4 can be supported by steady rest devices 32, 34 and 36; however, these devices are optional and are not necessarily employed in the hardening of the main bearings in the first station used in performing the method of the present invention. The steady rests contact the lower portion of the inner bearing surfaces 12, 14 and 16 to support these rotating surfaces by using reactive support platform 40. The first station for hardening the concentric cylindrical surfaces constituting the main bearings is followed by a second station for hardening a first group of orbiting pin surfaces and a third station for hardening a second group of the cylindrical pin surfaces. The use of two separate stations for hardening the pin bearings facilitates an aspect of the invention capable of producing a crankshaft with a total indicator run out (TIR) within a prescribed specification, such as less than 0.015 inches. The novel procedure of hardening the main bearings first and then two separate groups of pin bearings allows the TIR to be held within the desired specification. Furthermore, the apparatus and method of the present invention uses diagnostic setup procedures shown in FIG. 26 for assuring the desired tempered metallurgical characteristics around the total circumference of each of the individual cylindrical bearing surfaces.

Figure 2:
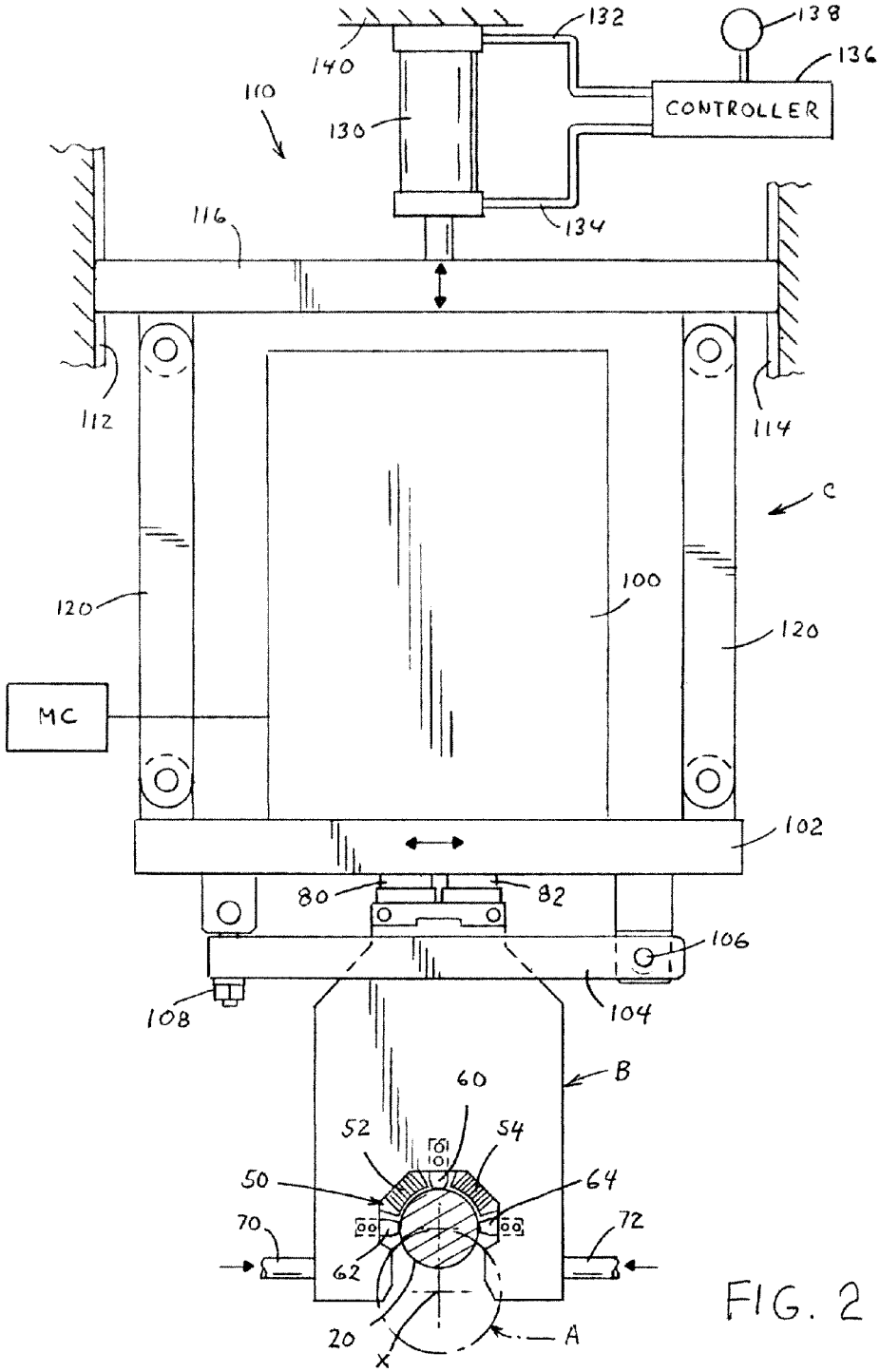
FIG. 2 is a schematic side elevational view illustrating one inductor for inductively heating and quench hardening a bearing surface of the crankshaft shown in FIG. 1.
Figure 3:
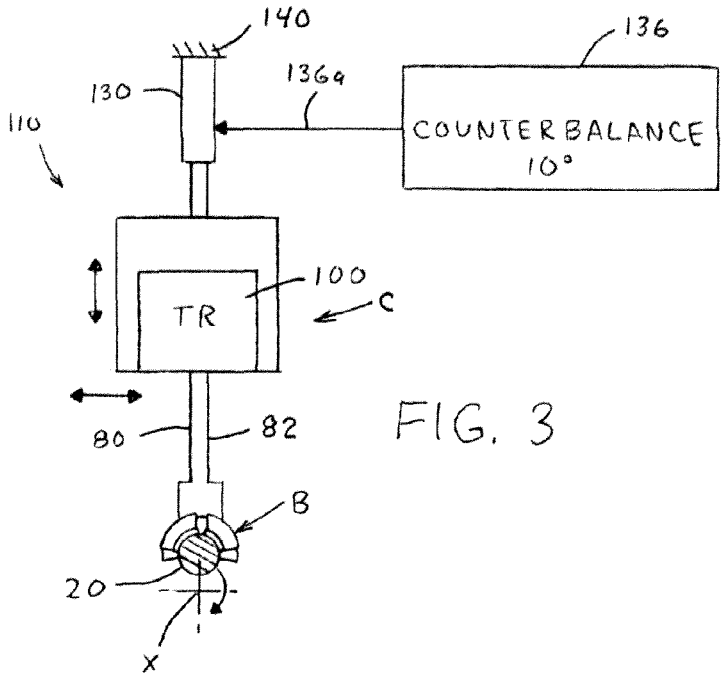
FIG. 3 is a simplified side elevational, schematic view similar to FIG. 2, but illustrating the pulsed counter balancing controller used in practicing the present invention.
Figure 4:
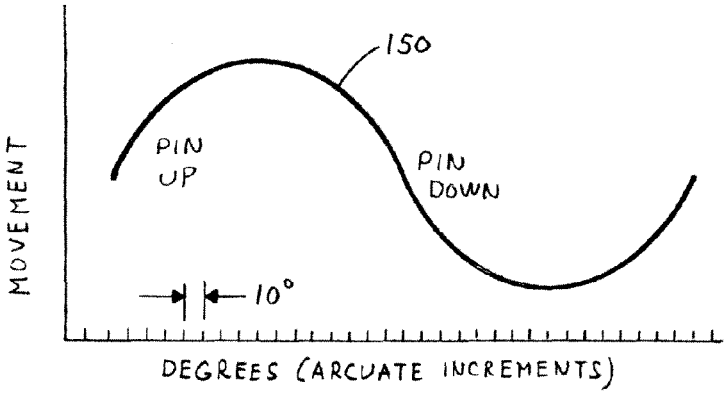
FIG. 4 is a motion graph of the vertical position for the counter balance mechanism shown in FIG. 3 at 10 degrees arcuate increments.
Figure 5A:
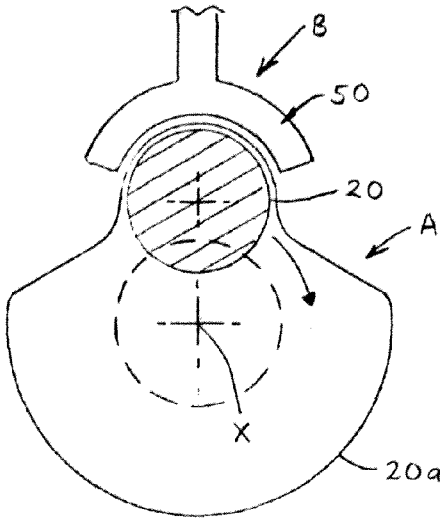
FIGS. 5A, 5B, 5C and 5D are enlarged side elevational views similar to the view in FIG. 3 illustrating the relationship of cylindrical pin bearing surfaces with respect to the counter balanced flanges of the crankshaft and the center rotational axis of the crankshaft.
Figure 5B:
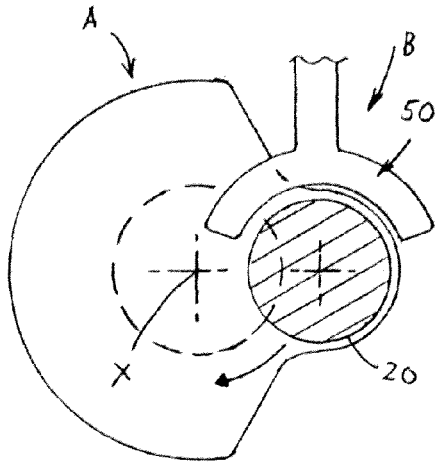
Figure 5C:
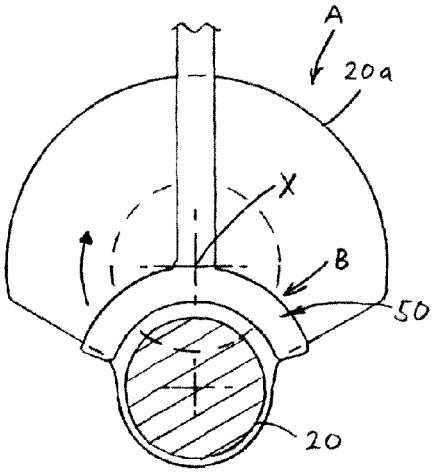
Figure 5D:
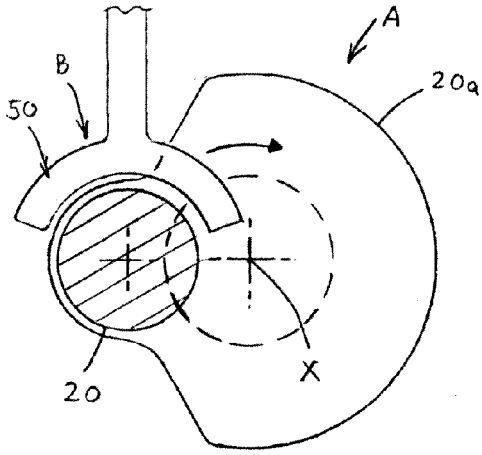

Each of the bearing surfaces is inductively heated and then quench hardened by an inductor assembly having the structure generally described in Griebel U.S. Pat. No. 5,451,749. This type of inductor assembly is schematically illustrated as inductor B shown in FIGS. 2, 3 and more specifically in FIG. 37. Inductor or inductor assembly B is used for processing each of the cylindrical surfaces; therefore, description of one assembly applies equally to the inductor or inductor assembly used for all of the cylindrical bearings processed in accordance with the present invention. Inductor B includes a hollow, single turn conductor 50 with an arcuate configuration extending over less than 180° of cylindrical bearing surface 20 being inductively heated. A cooling liquid is circulated through conductor 50. Laminations 52, 54 define the extent of the arcuate heating area for conductor 50 and shoes 60, 62 and 64 locate conductor 50 around the bearing surface. Shoe 60 rides along the top of surface 20 to maintain the desired induction heating gap between conductor 50 and surface 20. This gap is designed to provide proper induction heating of rotating surface 20 in the areas opposite laminations 52, 54. Quenching liquid is directed into inductor assembly B by liquid supply lines 70, 72 so a quenching liquid is propelled against surface 20 after conductor 50 has inductively heated the surface. Inductor B has upper connector structures 80, 82 for allowing coolant liquid to flow through hollow conductor 50. Furthermore, electric power lines extend through structures 80, 82. Consequently, both coolant and electrical power is directed to inductor B. Power for the induction heating of surface 20 is provided by power source 100 including a heavy transformer and a standard power controller. The power source is supported on platform 102 having a lower inductor assembly support arm 104 for mounting the inductor B onto platform 102. Support arm 104 includes a pivoted support pin 106 and a bolted assembly 108 to maintain inductor B onto platform 102 for movement of the inductor as surface 20 orbits around axis x. In accordance with standard practice, inductor B has a counter balancing mechanism 110 reciprocally mounting the power source and inductor assembly on rails 112, 114 by an upper vertically movable dolly 116. Four spaced, pivoted straps 120 connect dolly 116 to platform 102 so that inductor B can follow along the orbital path of surface 20. Of course, an inductor having this structure when used for a main bearing will not have the orbital amount of movement of support straps or hangers 120. The main bearings still require some oscillation of the inductor. Counter balancing mechanism 110 is used to limit the force exerted by shoe 60 on surface 20. The desired force level is 15-30 pounds. Since power source 100 can weight as much as 400 pounds, counter balancing mechanism 110 must be capable of moving inductor B in a sinusoidal path. This capability is important when pin bearings are being processed, since rotation of crankshaft A causes orbital movement of the pin bearing surfaces. Main bearing surfaces do not require substantial following movement of counter balancing mechanism 110. Mechanism 110 is schematically illustrated in FIGS. 2 and 3 as including a pneumatic cylinder 130 having control input lines 132, 134 extending from controller 136 having a supply 138 of air to cause cylinder 130 to move inductor B in a vertical direction in accordance with the desired position of inductor B as crankshaft A rotates. Of course, an hydraulic system could be used for the counter balance mechanism. In accordance with the invention, the counter balancing controller 136 changes the signal on line 136*a* each 10° arcuate movement or increment of crankshaft A. Thus, when a pin surface, such as surface 20 is being processed, cylinder 130 moves inductor B along the sinusoidal path 150, as schematically illustrated in FIG. 4. This allows a controlled force to be exerted by shoe 60 against pin surface 20. Controller 136 is updated each 10° arcuate increment to control the exerted force at shoe 60 during both induction heating and quench hardening. This movement of inductor B is schematically illustrated in FIGS. 5A-5D where pin surface 20 is shown with its normal counter balancing flange 20*a* as shown in FIG. 1. The heavier flange 20*b* is combined with the thinner flange 20*a* to provide a heat sink for surface 20, so the bearing has a top dead center as shown in FIG. 5A and a bottom dead center as shown in FIG. 5C. As so far described, each bearing surface of crankshaft A is inductively heated and quench hardened by an inductor B with a counter balancing mechanism for the pin bearings as schematically illustrated in FIG. 4. By using the inductor with its controlled power, quenching and counter balancing, the apparatus and method are obtained, as will be explained.

Overall Installation

Figure 6:
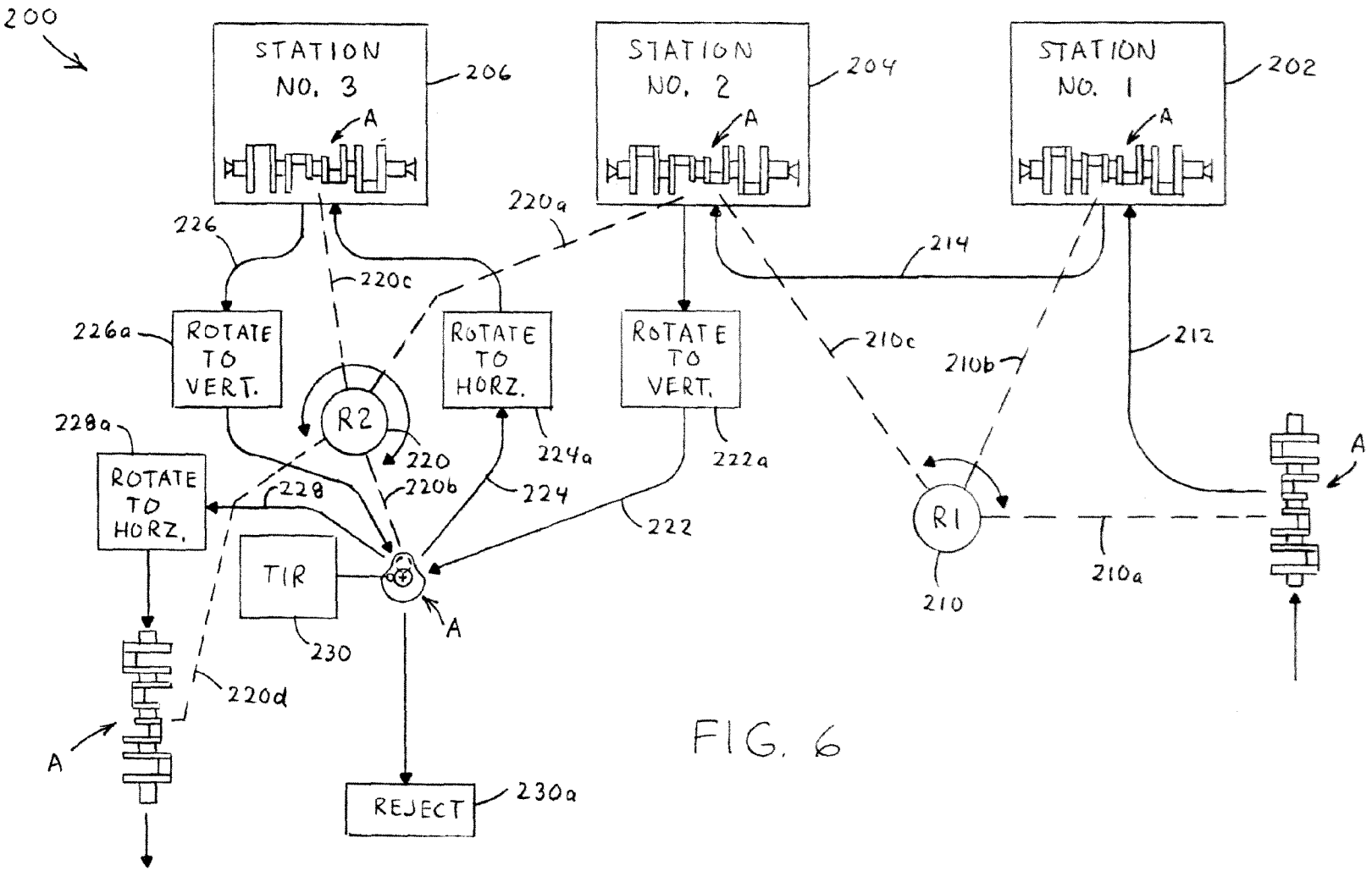
FIG. 6 is a schematic diagram of an installation to practice the invention with the three multi-surface hardening stations together with a motion diagram for transferring the crankshaft to and from the three induction hardening stations.

The apparatus and method for hardening the axially spaced cylindrical bearing surfaces of crankshaft A is performed by installation 200 schematically illustrated in FIG. 6. The production installation includes a first station 202, a second station 204 and a third station 206. These stations inductively harden selected cylindrical bearing surfaces by a method schematically illustrated in FIG. 37 for each of the individual bearing surfaces. In accordance with the invention, the main bearing surfaces are hardened first. This may be accomplished in a single first station 202, as shown in FIG. 6, or by two separate stations, combined to produce hardened main bearing surfaces for processing by stations 204, 206. In accordance with the invention, second station 204 inductively hardens inner pins P2, P3 and third station 206 hardens outer pins P1, P4. The production setup of these stations is preceded by a diagnostic procedure shown in FIG. 26 to provide desired tempered hardening over each 10 degrees arcuate increment for each of the various bearing surfaces. After that diagnostic procedure has been followed and the heating profile and the quenching and counter balancing parameters have been established, the production run as shown in FIGS. 35, 36 is implemented. Crankshaft A is processed by the equipment set forth in FIG. 6 using the values of the production run tables. A robot 210 moves crankshaft A along path 212 for loading the crankshaft into station 202 in a horizontal position between two spaced rotating centers (not shown). The centers have locator devices so station 202 rotates crankshaft A in a manner where each arcuate position is known. This locating technique is standard practice in inductively heating crank shafts. In accordance with the preferred embodiment of the invention, the five cylindrical surfaces of the main bearings are simultaneously inductively heated and quench hardened in station 202. Thereafter, robot 210 transfers crankshaft A with hardened main bearings to station 204 along path 214. In accomplishing these movements, robot 210 moves between positions 210*a*, 210*b* and 210*c* in accordance with standard robotic technology. In station 204, inner, orbital surfaces 22, 24 are inductively heated and then quench hardened in a manner to allow automatic tempering. It has been determined that the hardening in stations 202 and 204 produce a run out in essentially the same general direction. Consequently, before transferring shaft A to third station 206, the TIR of the main bearings is measured at auxiliary station 230. To accomplish this testing procedure, second robot 220 moves crankshaft A to the TIR measuring station 230 along path 222. This path includes a rotation movement of the robot indicated by block 222*a*. Thus, a horizontal crankshaft having hardened main bearings and a first group of hardened pin bearings is removed from station 204, rotated to a vertical position and then deposited in measuring station 230. After measuring the TIR of the main bearings in station 230, robot 220 moves crankshaft A along path 224 into third station 206. This path includes a rotating motion indicated by block 224*a*. Thus, the vertically oriented crankshaft A is moved into a horizontal position and loaded into station 206 between rotating centers with an appropriate angular identification device as used in all three stations, but not shown. If the run out measured in station 230 indicates that the end result of the TIR after hardening in station 206 will not be within the desired specification, the power for the hardening operation in station 206 is adjusted to compensate for any impending variations. Since the hardening in stations 202, 204 produce run out in the same direction, this directional run out is measured in station 230. If it is beyond a set amount, then the power in station 206 is increased If it is below a set amount, the heating in station 206 is decreased. It has been found that the TIR measured in station 230 is normally within a given range so the standard hardening procedure for the second group of cylindrical pin surfaces will bring the TIR into the desired specification. Then the crankshaft is completed. In an optional scheme shown in FIG. 6, robot 220 transfers crankshaft A along path 226 and rotates the crankshaft back to a vertical position as indicated by block 226*a*. The vertically oriented crankshaft is then again processed by TIR testing station 230 to determine the run out. If the run out is outside specification, crankshaft A is rejected as indicated by block 230*a*. When using the present invention, this event has occurred only a few times, less than 1%. Thus, crankshaft A is moved along path 228 and is rotated as indicated by block 228*a*. The crankshaft is now in the horizontal position and is ready for subsequent use. This is an optional arrangement since testing of TIR is normally after the crankshaft leaves installation 200.

An aspect of the invention is hardening a first group of pin bearings and then measuring the run out. Thereafter, a second group of pin bearings is hardened. If the run out after hardening the first group of pin bearings is in an area indicating that subsequent normal hardening will not bring the crankshaft back into specification, the subsequent group of pin bearings is hardened using more or less power to move the run out into specification. This procedure is an important feature of the present invention. The first group of pin bearings comprises the inner pin bearings and the second group comprises the external pin bearings. Although a first station is illustrated, as previously mentioned, the main bearings may be hardened in two groups before crankshaft A is transferred to station 204.

Quench Hardening Main Bearing

Figure 7:
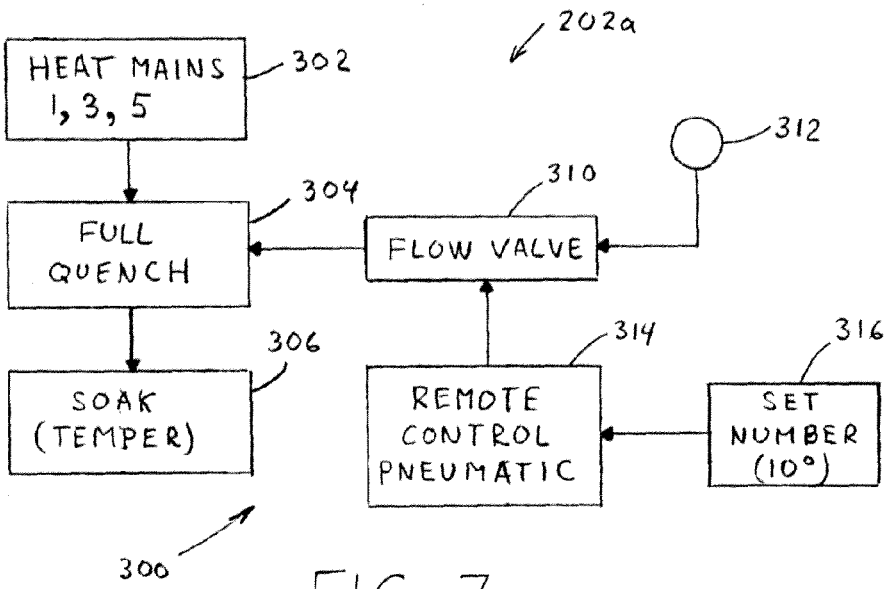
FIG. 7 is a block diagram and flow chart of a portion of the first station illustrating the quenching procedure used in quench hardening main bearings 1, 3 and 5.
Figure 8:
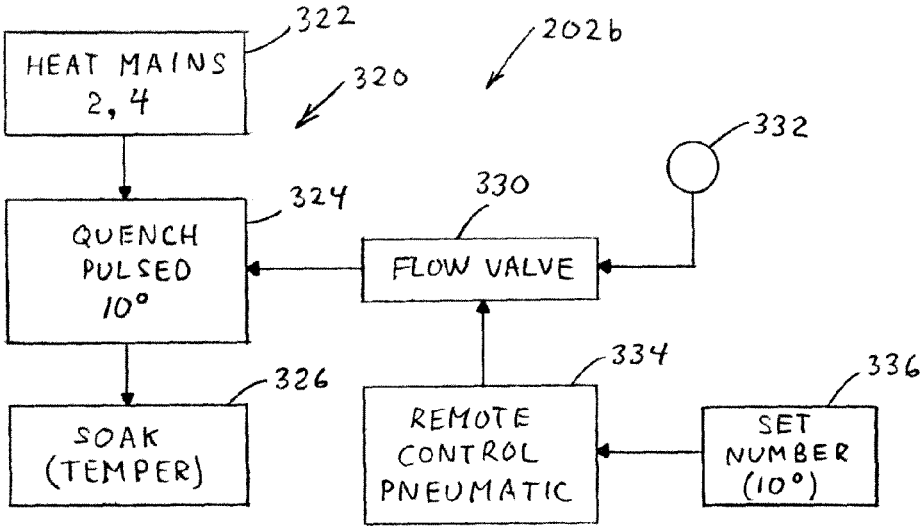
FIG. 8 is a combined block diagram and flow chart similar to FIG. 7 illustrating the quench hardening process used for main bearings 2 and 4 in the first station as shown in FIG. 6.
Figure 9:
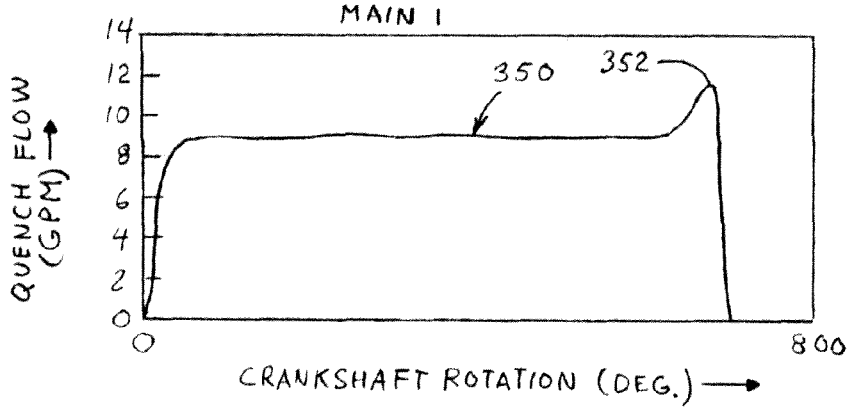
FIGS. 9-13 are graphs illustrating the volume of quenching liquid at 10 degrees increments for quench hardening main bearings 1, 2, 3, 4 and 5 using the procedure set forth in FIGS. 7 and 8.
Figure 10:
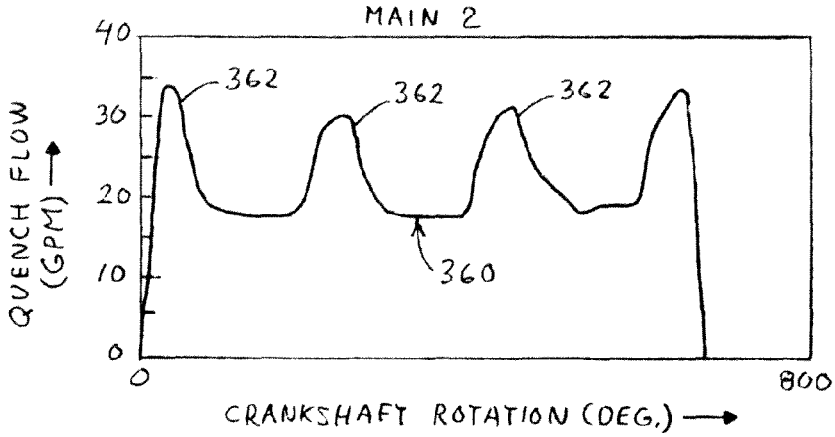
Figure 11:
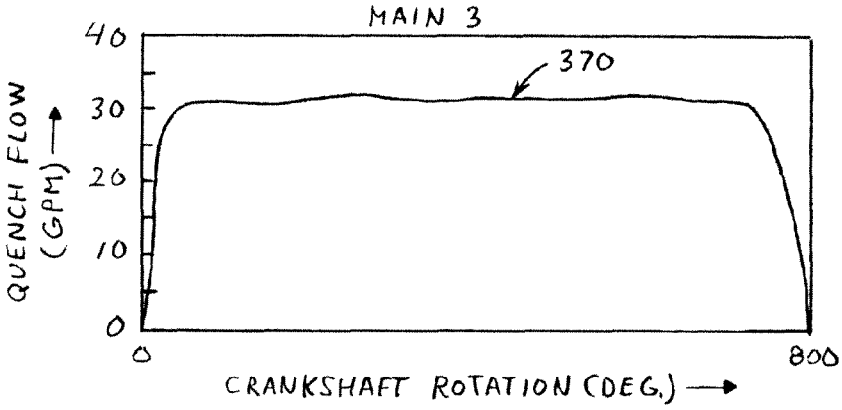
Figure 12:
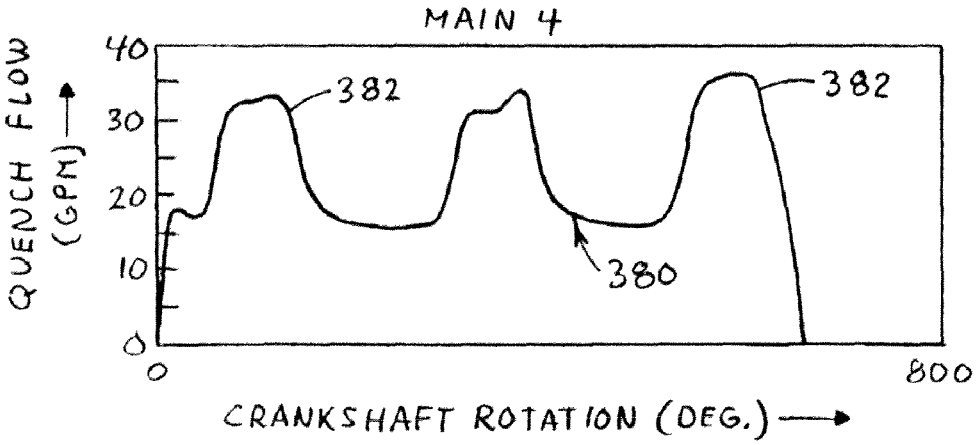
Figure 13:
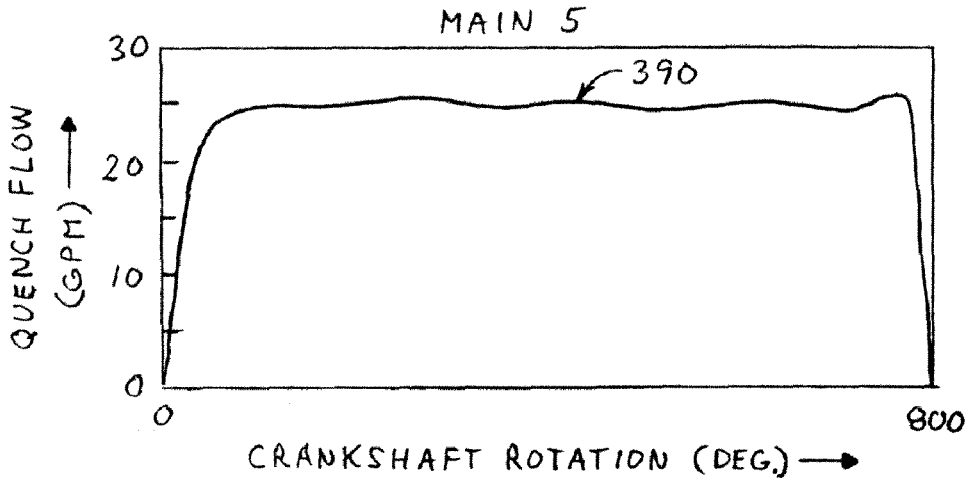

After the main bearings have been inductively heated, they are quench hardened to a temperature allowing a certain amount of automatic tempering. To accomplish the desired metallurgical characteristics and the desired run out, the quenching procedure for each main bearing surface is controlled over an arcuate increment of 10 degrees of a quench cycle amounting to several revolutions of the crankshaft. The increments are less than 30 degrees and preferably less than 20 degrees. The quench hardening protocol is disclosed in FIGS. 7-13 illustrating the quenching procedure performed in first station 202, as shown in FIG. 6. In accordance with the desired metallurgical characteristics and total run out, the main bearings are quench hardened by different liquid flow patterns, illustrated as a first sub-station 202*a* shown in FIG. 7 and a second sub-station 202*b* as shown in FIG. 8. The two separate quenching techniques are performed for different main bearings. Sub-station 202 is used for hardening main bearings 1, 3 and 5 by method 300. The main bearings are heated as indicated by block 302. Thereafter, the main bearings have a full quench flow indicated by block 304 until the surfaces are quenched and allow a certain amount of residual heat energy as indicated by block 306. During the full flow quenching of the surfaces for main bearings 1, 3 and 5, the flow of quenching liquid is controlled by valve 310 to change the amount of liquid directed from a supply of quenching liquid through quench lines 70, 72 as shown in FIG. 2. Flow valve 310 is controlled pneumatically by controller 314 and includes set flow volume positions indicated and activated as numbers. The output number for controller 314 is determined by an open loop technique reviewed each 10 degrees of rotation of crankshaft A as detected by sensor 316. Each of the individual shafts hardened in sub-station 202*a* has its own full flow quenching pattern, as set forth in FIGS. 9, 11 and 13. At the same time, sub-station 202*b* of first station 202 performs method 320 for quench hardening the intermediate bearings M2 and M4. By method 320, the two main bearings are heated as indicated by block 322 and are quenched by a pulse quenching operation illustrated as block 324. This quench hardening procedure using pulse quenching maintains a low total run out caused by hardening the intermediate bearings. Method 310 includes a subsequent tempering operation shown by block 326 so the quench hardening procedure results in a residual heat energy allowing a slight tempering action after the liquid quenching has been concluded. Flow valve 330 has a controller 334, which has a set number provided by angular sensor 336 reading arcuate increments, which in practice are 10 degrees. By using a full flow quenching of the outside and center main bearings and pulsed quenching in the intermediate main bearings, the total run out is somewhat controlled and appears in a given, known direction. Methods 300, 320 are performed at station 202 and the 10 degree measurements of sensors 316, 336 are the rotational positions of the crankshaft Use of these methods produces quenching operations shown schematically in FIGS. 9-13. In FIG. 9, a full quench flow as indicated by curve 350 is used for main bearing M1 processed as a closed loop process using sensor 316 as shown in FIG. 7. Spike 352 appears at the end of the quenching because of the turn off inertia. For main bearing M2, the quenching procedure shown in FIG. 8 is employed to produce a flow curve 360 having pulsed quenching portion 362. These portions allow the intermediate bearing to hold the two adjacent bearing surfaces more nearly centered. A full quenching operation for main bearing M3 is shown as curve 370 in FIG. 11. A pulsed quenching operation is shown in curve 380 in FIG. 12 having pulsed portions 382 for main bearing M4. The final main bearing M5 has a full quench flow as curve 390 in FIG. 7. FIGS. 7-13 illustrate the preferred embodiment for quench hardening the main bearings in station 202 to produce a desired small run out, which run out is known to be in a given direction with respect to the various counter balancing flanges of crankshaft A.

Quench Hardening of Pin Bearings

Figure 14:
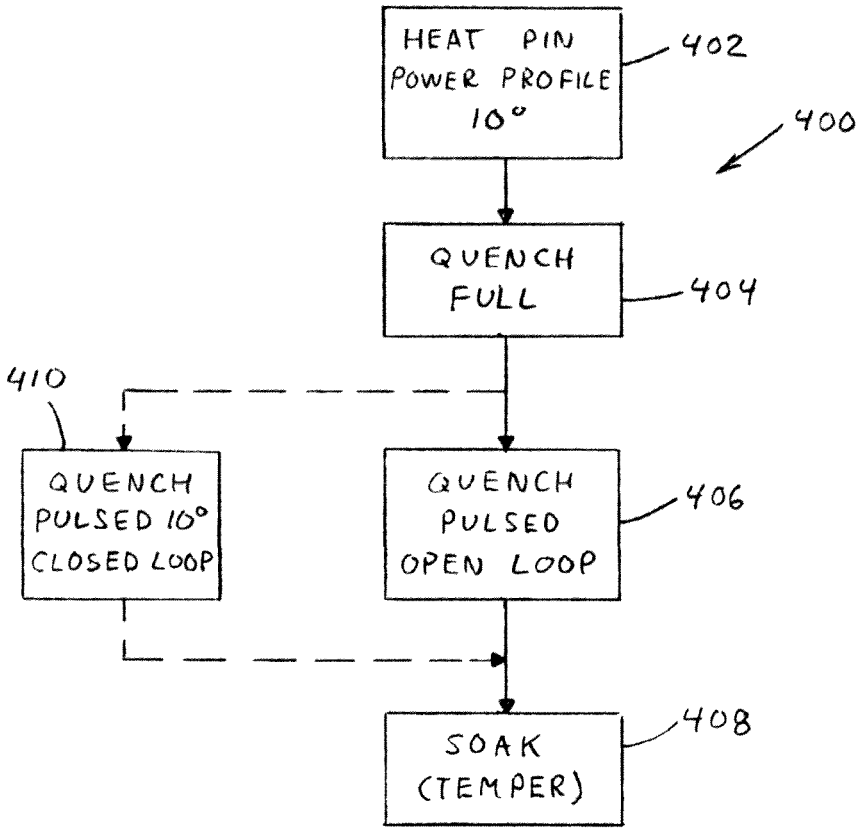
FIG. 14 is a combined block diagram and flow chart for the process for hardening one of the orbiting cylindrical pin surfaces illustrating an open loop preferred implementation of the invention and a closed loop implementation of the present invention.
Figure 15:
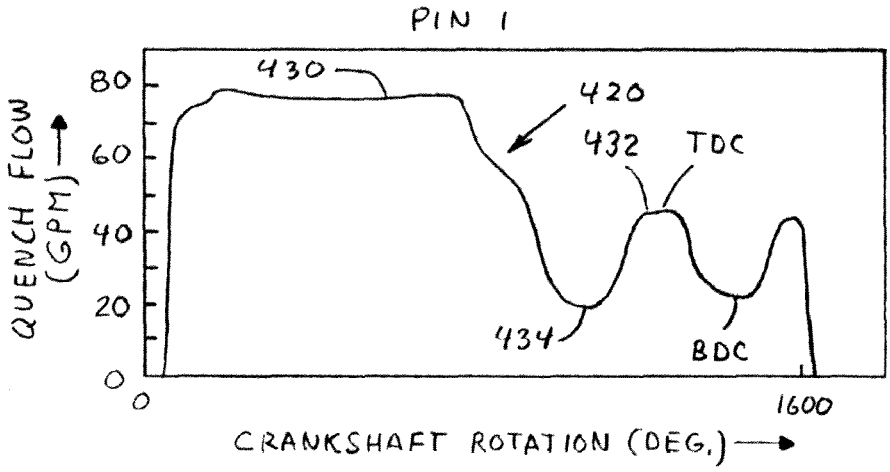
FIGS. 15, 16, 17 and 18 are quench flow graphs illustrating the quenching procedure for the orbiting pins after they have been inductively heated illustrating an aspect of the invention for controlling the metallurgical characteristics of the pin surfaces.
Figure 16:
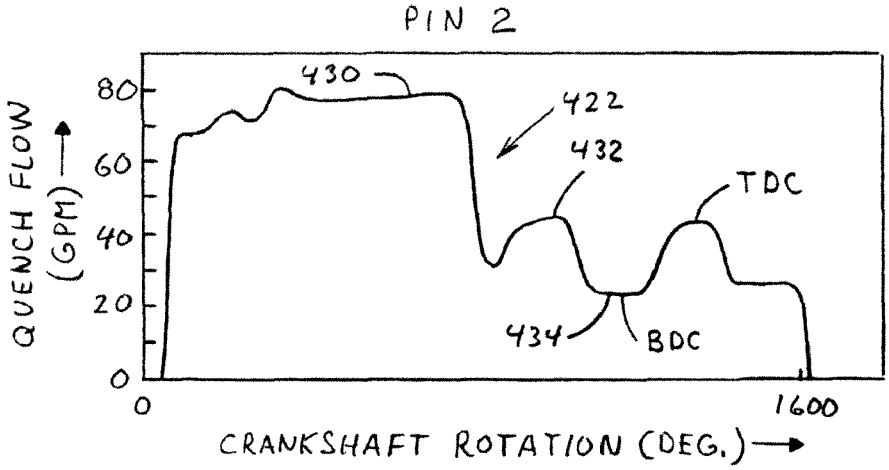
Figure 17:
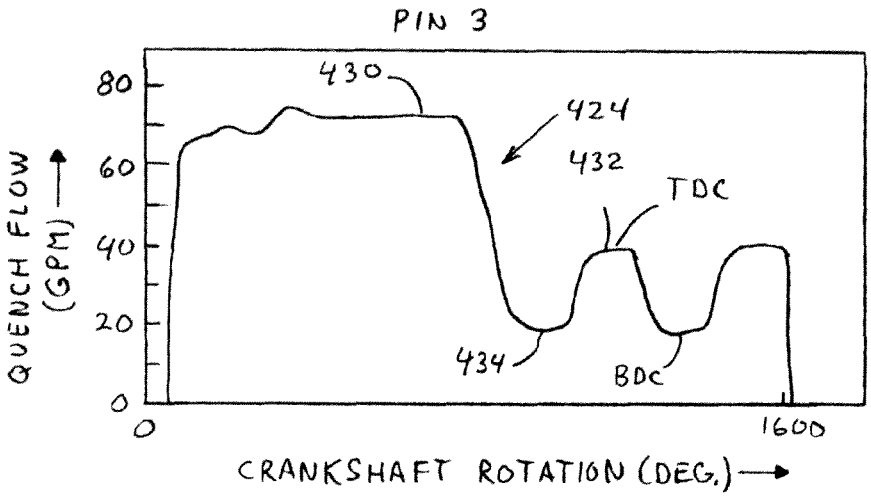
Figure 18:
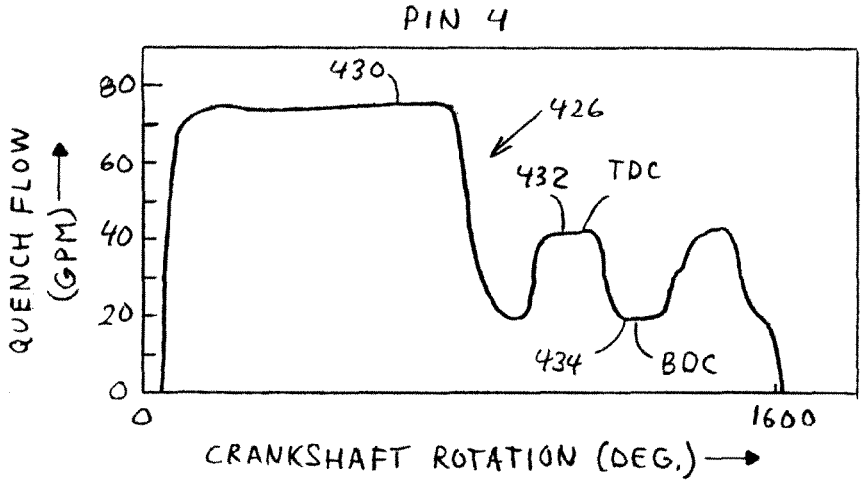

The pin bearings are quench hardened in stations 202, 204 of FIG. 6 utilizing a pulsed quenching procedure that is novel and is illustrated as method 400 in FIG. 14. The pin bearing is heated with a power profile that is changed every 10 degrees of rotation of the crankshaft, as indicated by block 402. The increments are less than 30 degrees and preferably less than 20 degrees. But in practice they are about 10 degrees. Thereafter, there is a full flow quench portion, as indicated by block 404. After a short full quench procedure, flow controller, such as controller 334, 336 shown in FIG. 8, is used to produce pulses of quenching fluid by changing the number for the flow valve 330. This procedure illustrated as block 406 is continued until the pin bearing surface is hardened to a desired amount while allowing a certain amount of residual heat energy to provide a slight tempering, as indicated by block 408. Thus, each of the pins is first quench hardened with a full flow and then quenched with a series of liquid pulses. As indicated by block 410, preferably these quench pulses are in a closed loop and controlled by the rotation of crankshaft 10 through a given arcuate increment which is preferably 10 degrees. However, they may be done in an open loop control. By providing pulsed quenching, the metallurgical characteristics of the pin bearing surfaces is maintained in the desired range and there is a uniform effect upon the resulting run out. The quench flow curves for the various pins are set forth in FIGS. 15-18. Pin P1 is quench hardened by liquid flow illustrated as curve 420 in FIG. 15. Curve 422 shown in FIG. 16 is employed for pin P2. The third pin P3 utilizes liquid flow represented by curve 424 in FIG. 17 and the final pin P4 is quench hardened by quench liquid flow as represented by curve 426 in FIG. 18. Each of these curves include a full quenching segment or portion 430 using the method set forth in FIG. 7 and then a pulsed quench liquid flow as created by the procedure set forth in FIG. 8. When coordinating the quenching of the pin surfaces with the rotation of the crankshaft, the pulses 432 are coordinated with the top dead center of the pin and the crest between the pulses is coordinated with the bottom dead center of the pin. FIGS. 14-18 illustrate a novel aspect of the present invention wherein the crank pins in the two separate hardened groups of station 204 and 206 utilizes a quenched flow that is first continuous and then pulsed. This provides uniformity of run out and also allows cooling coordinated with the necessary heating at both the top dead center and the bottom dead center of the crank pin as it rotates.

Control of Run Out

Figure 19:
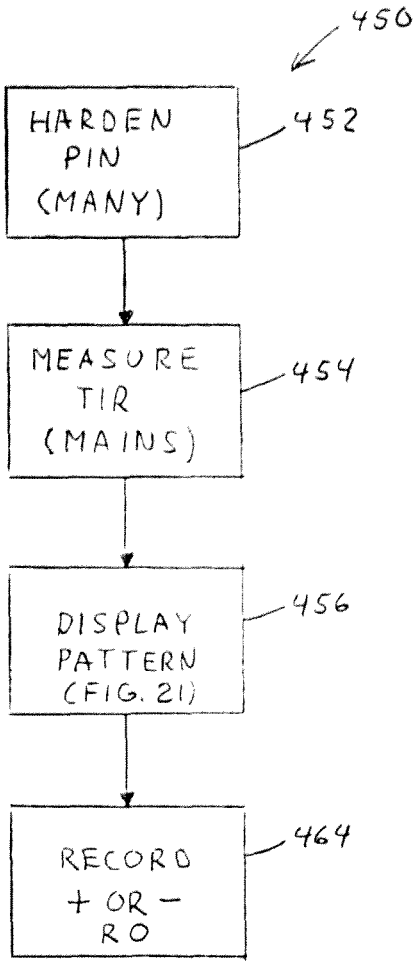
FIG. 19 is a combined block diagram and flow chart of the procedure for determining the distortion effect in hardening a particular group of pin bearings.
Figure 20:
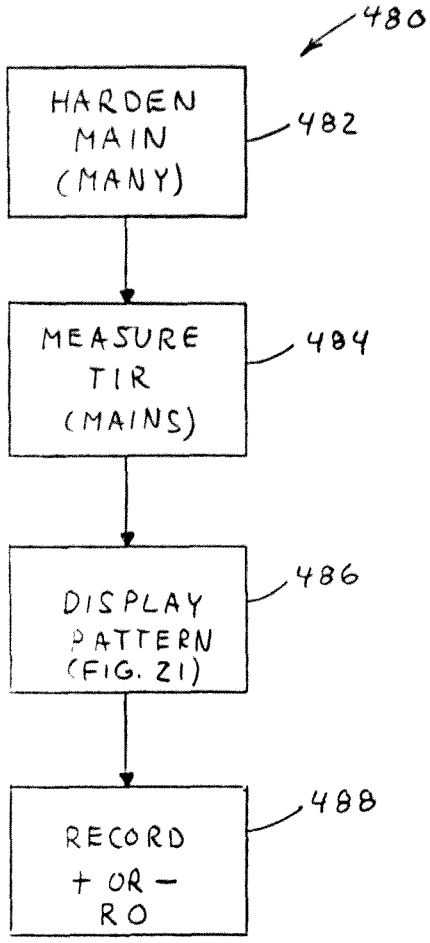
FIG. 20 is a combined block diagram and flow chart of a procedure similar to the process disclosed in FIG. 19 for measuring the distortion obtained by hardening the main bearings in station 1 of the installation shown in FIG. 6.
Figure 21:
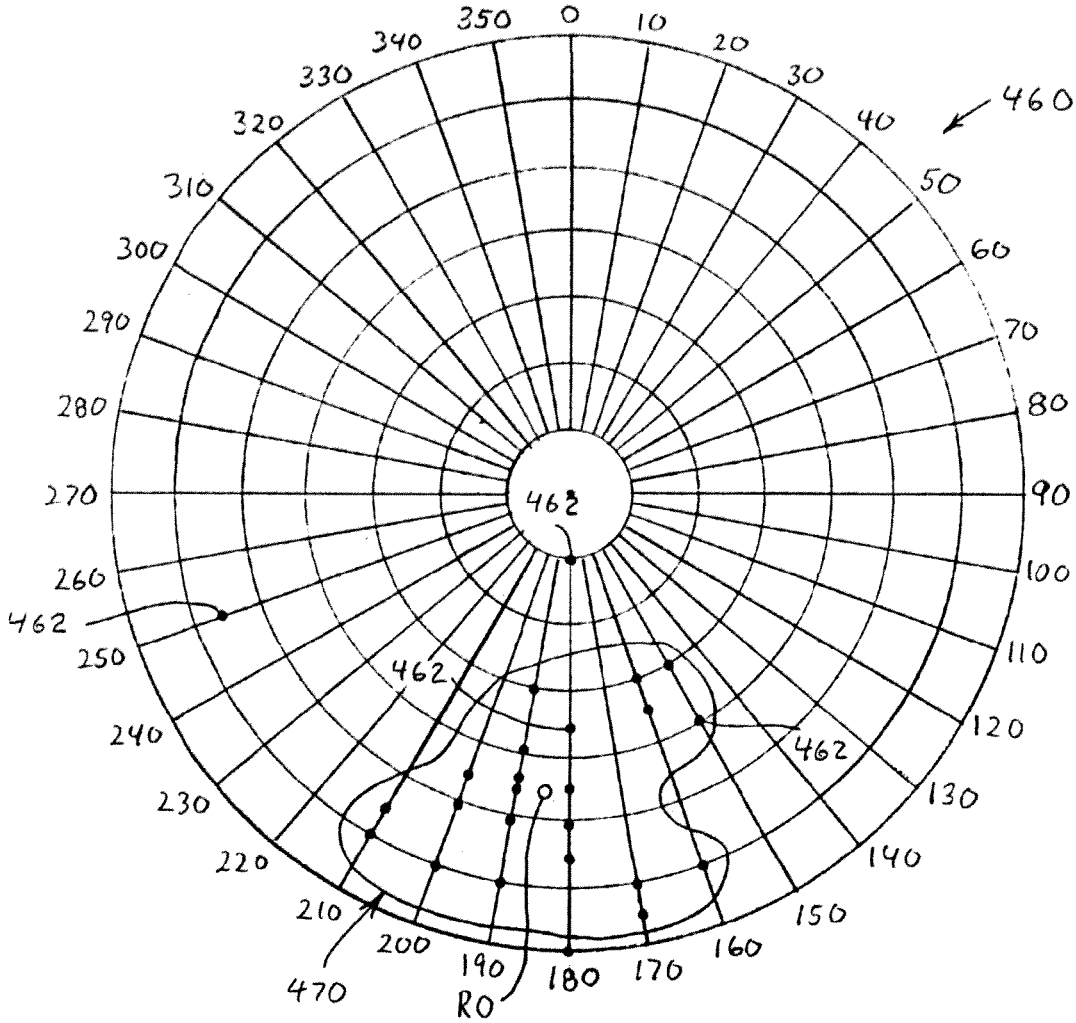
FIG. 21 is a circular plotting chart illustrating the end result or effect of performing a basic feature of the procedures disclosed in FIGS. 19 and 20.
Figure 22:
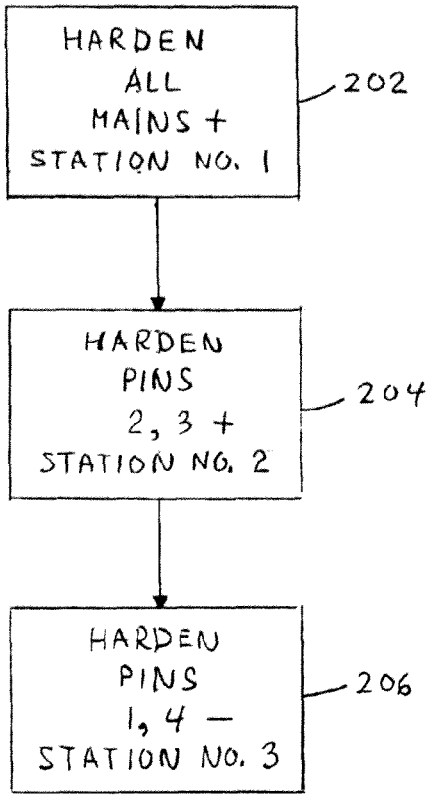
FIG. 22 is a combined block diagram and flow chart of the procedure for sequentially hardening the main bearing surfaces and the two groups of pin bearing surfaces employing stations 1, 2 and 3 as illustrated in FIG. 6.
Figure 23:
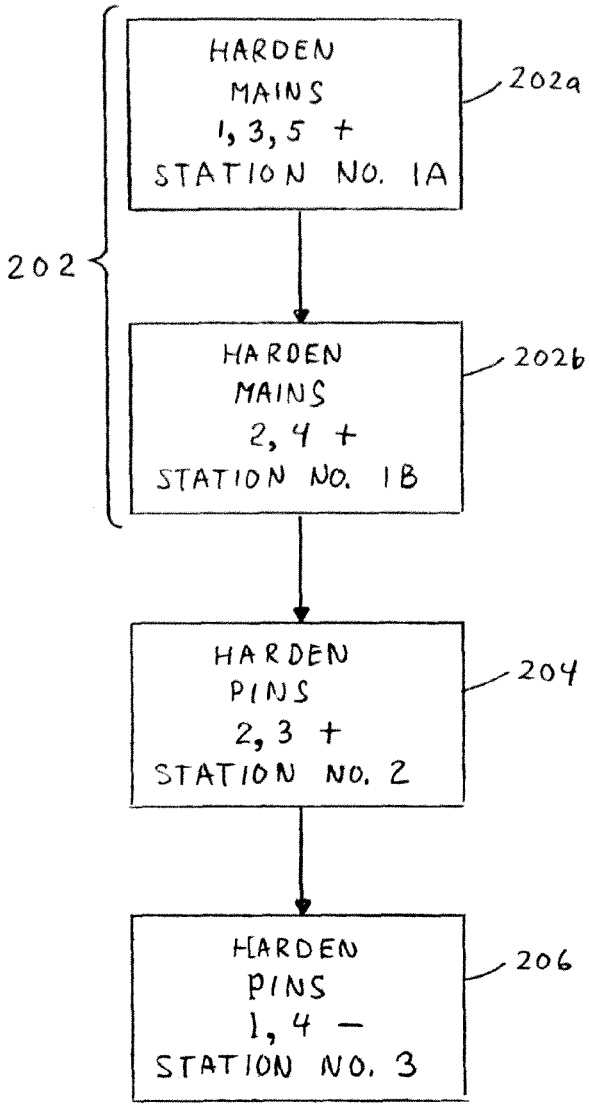
FIG. 23 is a combined block diagram and flow chart of an alternate implementation of the three stations installation illustrated in FIG. 6.
Figure 24:
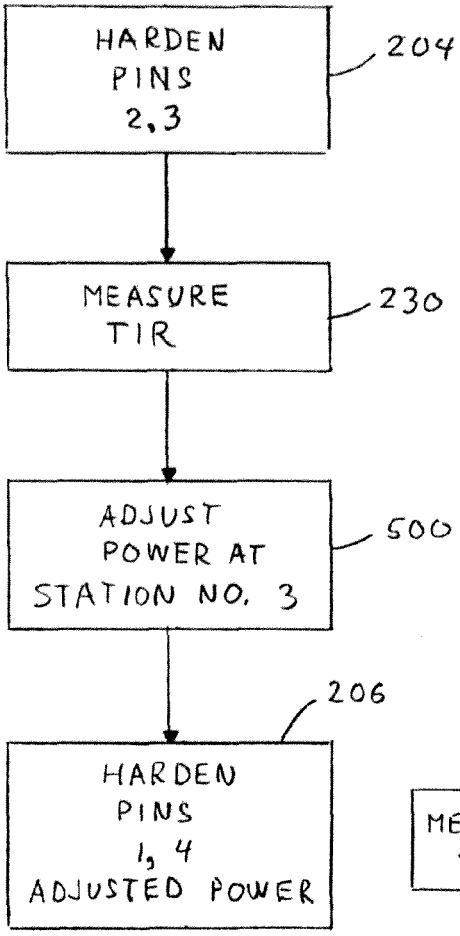
FIG. 24 is a combined block diagram and flow chart for the aspect of the invention for limiting the total indicator run out of the crankshaft shown in FIG. 1.
Figure 25:
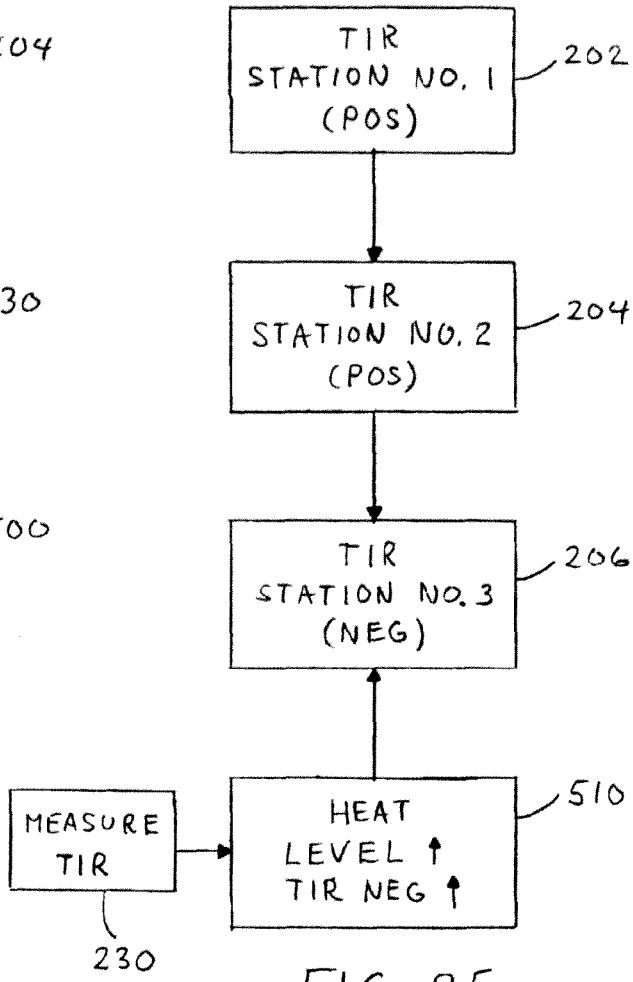
FIG. 25 is a combined block diagram and flow chart illustrating the technical characteristics facilitating the procedure set forth in FIG. 24.

The apparatus and method of the present invention controls the extent of final run out for crankshaft A by first hardening main bearings either in two separate stations or, preferably, in a single station 202. By a procedure set forth in FIGS. 19-21, the run out for the operation of station 202, the run out for station 204 and the run out for station 206 is known so that these known physical characteristics of the heating operation are used to create a crankshaft that is hardened and also has minor total indicator run out. To determine the direction of run out caused by hardening of the pins, test pins are hardened as a group and tested according to method 450, shown in FIG. 19. This method involves taking several crank shafts and hardening a group of pins, such as pins P2 and P3 or pins P1 and P4. This process is indicated by block 452. After the pins have been hardened, the run out of the shaft is tested by a total indicator run out (TIR) station, such as station 230 used in FIG. 6. This testing procedure is set forth in block 454 and is followed by displaying the actual pattern run out for the many shafts tested. The run out is determined after the group of pins has been hardened. This run out is plotted on circular chart 460 as shown in FIG. 21. Measured run out points are plotted on chart 460 as indicated by the many dots 462. The grouping of the dots is concentrated in areas 470 to give a mean run out RO for the crankshaft when a given group of pins is hardened. This run out is used in performing the method, as explained in connection with the installation layout of FIG. 6. By performing the method 450 on the two separate groups of pin bearings, it has been found that one group of pin bearings has a positive run out RO and the other group has a negative run out RO. This discovery is used in the invention for limiting run out. The same testing method is implemented to determine shaft run out after only the main bearings have been hardened. This main bearing run out testing method is illustrated as method 480 in FIG. 20. The main bearings are hardened as indicated by block 482. The shaft TIR is measured as indicated by block 484 and is displayed as a pattern on circular chart 460 shown in FIG. 21. This determines the run out for the main bearings. It has been found that the main bearing run out is in one direction indicated to be positive and the two pin bearing run out RO are positive for the bearing group containing pins P2 and P3. The run out caused by hardening pins P1 and P4 is a negative run out. For this reason, the first group of pins is hardened in station 204 and the second group of pins is hardened in station 206. Consequently, the run out for the first group is added to the run out for the main bearings and is compensated for by run out experienced in the second group of hardened pins. This procedure is shown in FIGS. 22 and 23, as previously described. Station 202 or combined stations 202*a*, 202*b* hardens all of the main bearing surfaces. This produces a run out direction referred to as positive. Then, station 204 is used to harden the first group of pins that have been determined to present a run out in the same direction as the main bearing run out. To compensate for the run out experienced at station 204, the hardening procedure at station 206 provides compensation and, thus, corrects the shaft run out to produce a crankshaft within the run out specification. In accordance with this aspect of the invention, by measuring the run out of the crankshaft after station 204, the heating procedure or profile in station 206 is adjusted to assure that the compensation by the hardening procedure in station 206 is such to overcome extreme run out caused by hardening in stations 202, 204. The crankshaft is relatively straight so subsequent straightening is not required. The procedure for controlling the run out is summarized in FIG. 24 wherein the hardened pins P2 and P3 in station 204 produces a run out as determined by use of measuring station 230. If the total positive run out is greater than a given value, the amount of power used in station 206 is increased If the measured run out is less than a certain value, then the standard power for station 206 is reduced. This power adjustment procedure is indicated by block 500 in FIG. 24. Thereafter, station 206 is used to harden pins P1 and P4 with the adjusted amount of power. This procedure is made possible because the run out in stations 202 and 204 are in one direction and the run out in station 206 is in the other direction. This concept is schematically shown in FIG. 25 wherein step 510 adjusts the amount of run out in the direction created in station 206 to compensate for the measured run out at station 230. The selection of determined consistent run out in the various stations is used to implement one aspect of the invention which aspect produces a crankshaft with a low amount of total indicator run out.

Diagnostic Profiling

Figure 26:
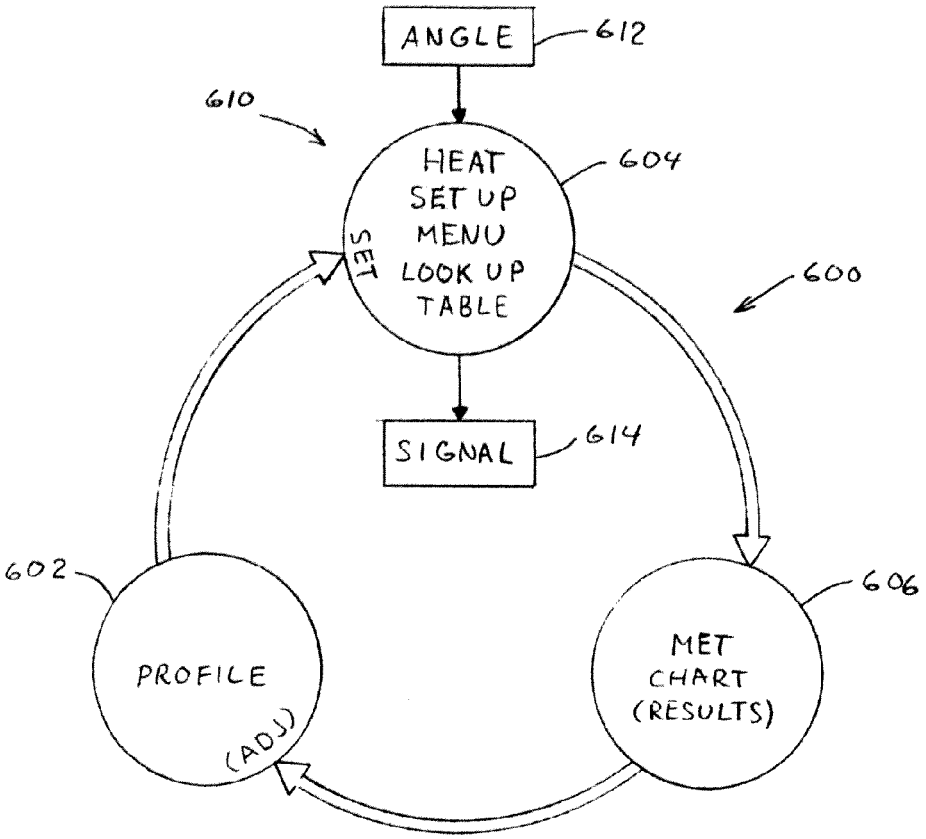
FIG. 26 is a circular diagram of the procedure for constructing a heat profile to create a look up or data table for controlling the heating cycle of an individual cylindrical surface.
Figure 27:
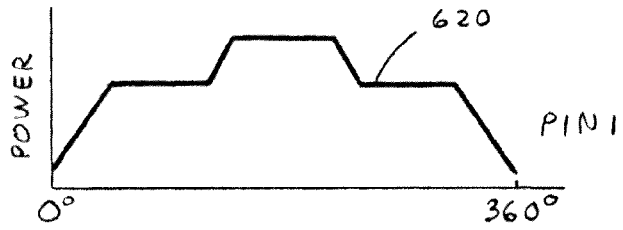
FIGS. 27-33 are representative profiles for the production run created by using the diagnostic procedure schematically illustrated by the chart in FIG. 26.
Figure 28:
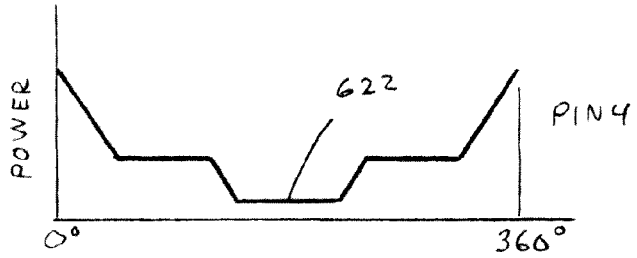
Figure 29:
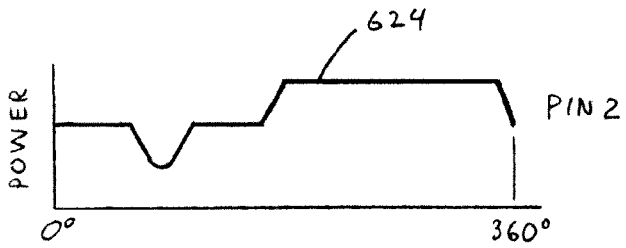
Figure 30:
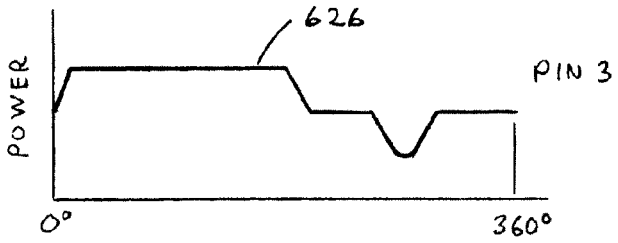
Figure 31:
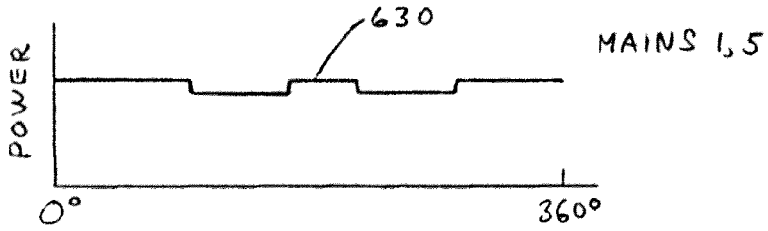
Figure 32:
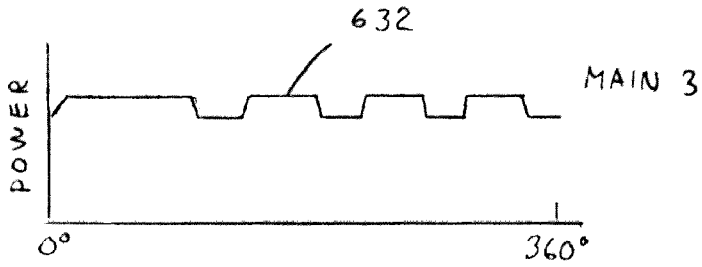
Figure 33:
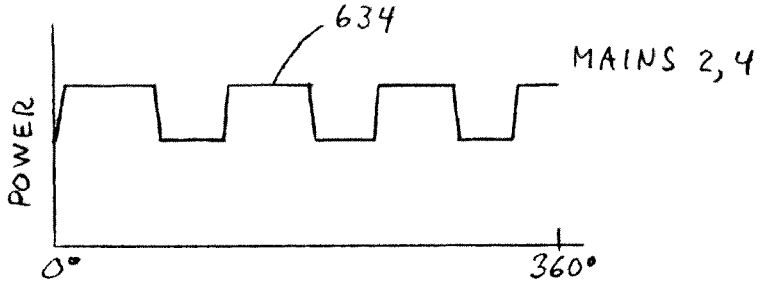

Another aspect of the invention provides methods for induction hardening internal combustion engine crankshaft bearing surfaces using tuned profiles for angularly incremented provision of power, quenching fluid, and inductor counter balancing as the treated crankshaft is rotated about the main bearing axis, by which an induction hardening process can be tailored to achieve a desired post-hardening metallurgy. This technique involves induction hardening one or more test crank shafts using initial profiles for power, quenching fluid flow rate, and/or inductor counterbalancing force which measuring various actual process values, such as applied inductor voltages, currents, quench flow rates, etc. at each associated control increment, and thereafter measuring one or more post-hardening crankshaft characteristics, such as hardened surface metallurgy, crankshaft TIR, and/or markings on the counter balance apparatus (e.g., shoe markings). One or more of the power, quench flow, and/or counter balance profiles are then adjusted according to one or more of the measured process profiles and/or crankshaft characteristics, and thereafter further crank shafts are hardened using the adjusted profiles. The process may be repeated any number of times to establish an optimized set of profiles for use in production hardening to achieve the desired metallurgical characteristics of a tempered hardened surface without requiring subsequent heat treatment of the bearing surfaces. One example is illustrated in FIG. 26 with respect to applied power profile adjustment based on measured metallurgy in accordance with this aspect of the invention, wherein similar techniques may be employed with respect to more than one profile with adjustments being made based on one or more measured crankshaft characteristics and/or based on one or more measured process parameter. The example of FIG. 26 employs a diagnostic profiling technique 600 to create a profile for the level of the power at each 10 degrees arcuate increment over 360 degrees. This power profile stored in area 602 is digitized as a menu or look up table in memory device 604. Thus, the profile in device or area 602 sets the level of signals from a data table in memory device 604. The data is outputted at specific angular segments as crankshaft A is rotated. During the setup procedure before the production run, a particular bearing surface is heated in accordance with a power profile stored device 602. The resulting hardened surface is analyzed metallurgically in a laboratory to determine the metallurgical characteristics around the bearing surface. This procedure is represented as laboratory procedure 606. To the extent that the surface does not have the desired characteristics at all locations, the power profile is modified or adjusted. The interactive diagnostic procedure is continued by changing the look up table in memory device 604 and testing the metallurgy. This process is repeated many times for each bearing surface before a power profile for production is created. The heating cycle around 360 degrees of each bearing surface is controlled by an ultimately created profile. After the profile has been created and transferred to the look up table, the table controls the heat cycle to accomplish the desired metallurgical results. At this time, the heat profile is finalized for use in production. Memory device or look up table 604 is used to control the power supply. A closed loop system 610 controls the power source. The angle of rotation sensed by device 612 addresses the look up table in memory device 604 to produce the desired output signal 614 for each 10 degrees arcuate increment. The increments are less than 30 degrees and preferably less than 20 degrees. In practice they are about 10 degrees. The profile for heating the pins is set forth in FIGS. 27-30 wherein the heating power around the crankshaft has the power profiles 620, 622, 624 and 626 for pins P1, P4, P2 and P3, respectively. As shown, pins P1 and P4 are heated by profiles that are generally mirror images, since they are at opposite sides of the rotational axis of crankshaft A. In a like manner, the power profiles 624, 626 of pins P2 and P3 have power profiles that are generally mirror images of each other. They are also on opposite sides of the crankshaft. The power profiles 630, 632 and 634 for the main bearing surfaces are illustrated in FIGS. 31, 32 and 33. As can be seen, the power profiles 630, 632 for heating bearing surfaces M1, M3 and M5 are essentially constant power, whereas main bearings M2 and M4 have profiles that are pulsed, according to the rotational position of the crankshaft. Pulsing power supply is beneficial, since the main bearings M2 and M4 have counter balancing flanges on both sides.

Figure 34:
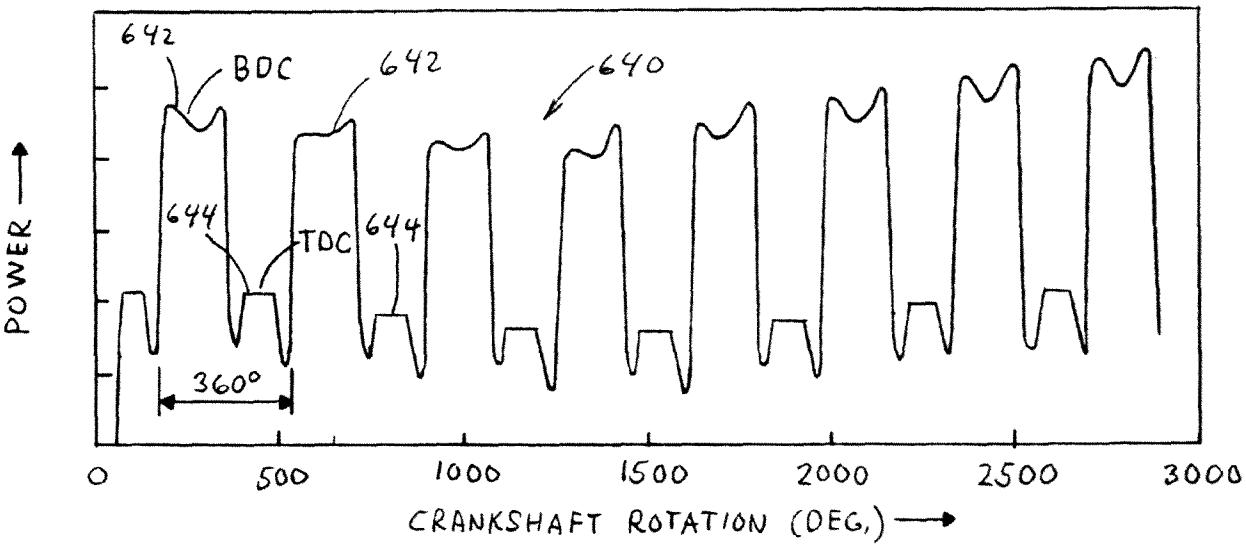
FIG. 34 is a typical voltage profile for the power directed to a pin using one of the profiles set forth in FIGS. 27-33.

The heat or power profile are repeated over 360° of rotation and are monitored for changing each arcuate increment, which is less than 30° and more particularly less than 20°. In practice the increments are about 10°. This is shown for one pin in FIG. 34 where a typical voltage profile for a total heating cycle of a pin is shown as curve 640 with high heating 642 at bottom dead center of the pin and low heating 644 at top dead center of the pin.

The signal levels of heating, as well as adjusted quenching and counter balance, for the pin bearings are provided in the table shown in FIG. 35. These values have been generated using the metallurgical adjustment of the diagnostic scheme illustrated in FIG. 26 for the heating profiles. The values for the various signals at each of the 10 degrees arcuate increments for quenching and counter balance are also determined diagnostically before the table of signals is used for production. Main bearings use the heating profiles and other levels as shown in the table of FIG. 36. Diagnostic procedures generate signals to determine the power, quench flow and counter balance position at 10 degrees increments of the rotating crankshaft, wherein one or more process profiles may be adjusted automatically or manually to refine the induction hardening process.

System

Figure 37:
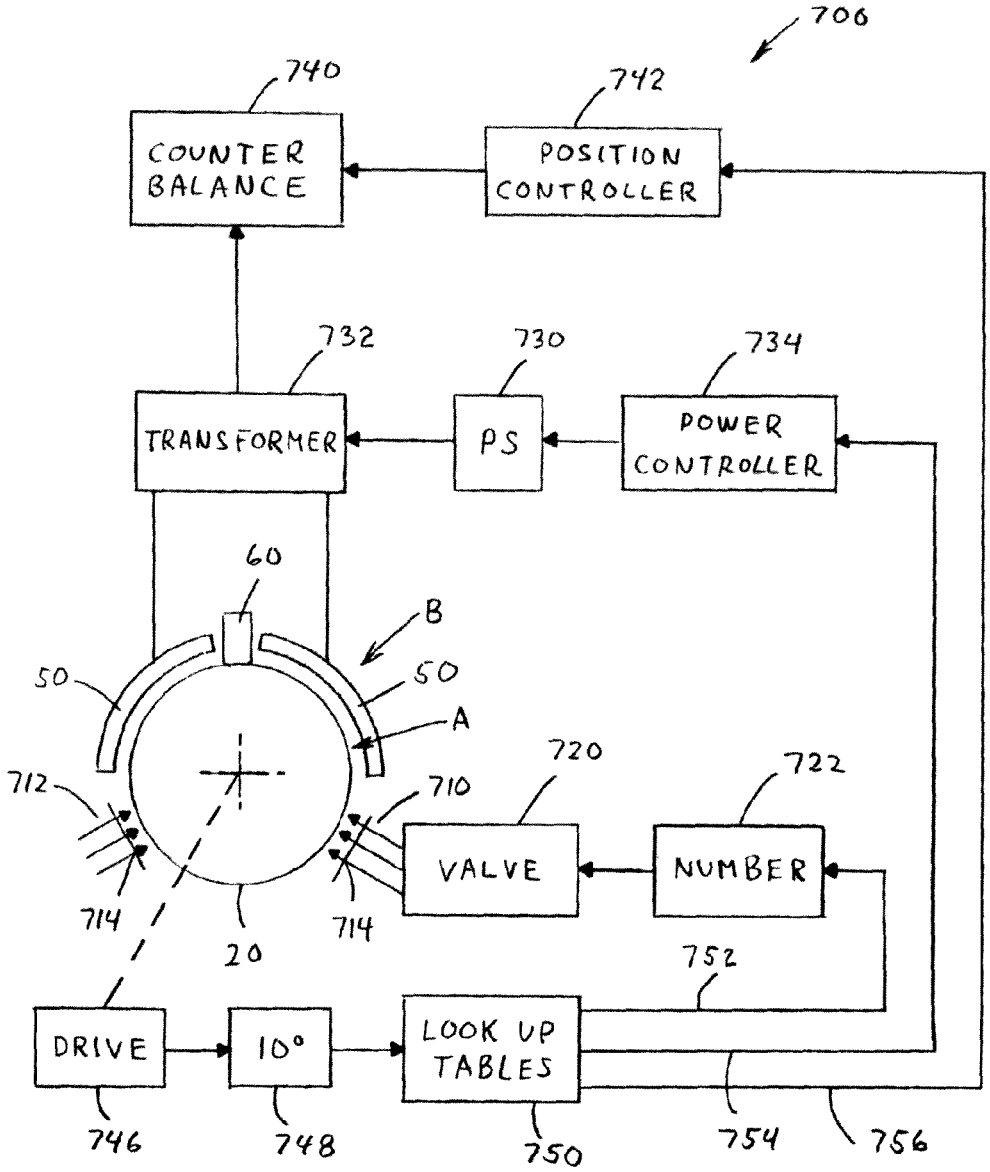

The general system of the present invention for each hardening station used in installation 200 of FIG. 6 is schematically illustrated in FIG. 37, The desired values for all angular positions are illustrated by one example shown in the tables of FIGS. 35 and 36. The positions of the tables are for a single rotation of the surfaces, as used for the power profiles set forth in FIGS. 27-33. Heating and counter balancing is generally related to a single rotation of the crankshaft. Quenching is performed over several rotations of the crankshaft. However, the pulsing procedure for after a full flow quench is also pulsed repeatedly over 360 degrees of the surface to match TDC and BDC. A system operated in accordance with the present invention is shown in FIG. 37. Crankshaft hardening system 700 for each of the surfaces includes a quench chamber 710, 712 associated with inductor B and having flow valve 720 operated by controller 722 in accordance with the input signal to the controller. In a like manner, the heat energy for induction heating by inductor B is provided by power source 730 operated through transformer 732. The level of output power is determined by controller 734 that is adjusted for each arcuate increment of the rotational motion of crankshaft A. As previously described, counter balancing mechanism 740 has a position controller 742 for adjusting the position or force exerted by shoe 60 on the bearing surface. A resolver 746 determines the exact angular position of the crankshaft and drives output 748. This increments look up table or data table 750. The table contains levels for each 10 degrees arcuate increment as illustrated by a representative process having the control signal levels of the tables in FIGS. 35 and 36. These levels are used over 360 degrees for heating and counter balance. They are the levels of quench liquid flow during pulse quenching of pins P1-P4 and main bearings M2 and M4. In accordance with the levels shown in the control tables of FIGS. 35 and 36 memory device 750 creates specific signals in lines 752, 754 and 756 for periodically updating controllers 722, 734 and 742, respectively. System 700 operates in accordance with the tables set forth in FIGS. 35 and 36 to process specific bearing surface in stations 202, 204 and 206, as shown in FIG. 6. In this manner, the metallurgical characteristics of the surfaces are maintained, while also providing a relatively straight crankshaft without straightening required.

Having thus defined the invention, the following is claimed:

1. An apparatus for hardening surfaces of a crankshaft wherein the crankshaft has a plurality of bearings that include a plurality of main bearings and a plurality of orbital bearings and wherein the main bearings are concentrically oriented on a center axis of said crankshaft and wherein the orbital bearings are offset to the center axis of the crankshaft and wherein the orbital bearings and said main bearings each having an outer bearing surface, said apparatus comprising an inductor, a quench chamber, a flow controller, a counterbalancing mechanism, and a master controller, said inductor at least partially encircling said outer bearing surface of at least one of said bearings to be hardened when said crankshaft is positioned in said apparatus, said inductor connected to a high frequency power source with a power controller to cause said power source to direct power to said inductor as said inductor heats said outer bearing surface of at least one of said bearings, said quench chamber including a plurality of outlet orifices directed toward at least a portion of said outer bearing surface of at least one of said bearings when said crankshaft is positioned in said apparatus, said flow controller directing a given quantity of quench fluid to said quench chamber and through said outlet orifices so that said quench fluid is directed against said outer bearing surface of at least one of said bearings after at least one of said outer bearing surface has been heated by said inductor, said counterbalancing mechanism including a counterbalance controller for controlling a riding force of said inductor against at least a portion of said outer bearing surface of at least one of said bearings that is at least partially encircled by the inductor, said master controller creating output signals to control and change a) an output level from said power controller, b) a flow rate of quench fluid from said flow controller, or combinations thereof, said master controller creating i) a heating profile, ii) a quenching profile, or combinations thereof for a) heating at least a portion of said outer bearing surface of at least one of said bearings, b) quenching at least a portion of said outer bearing surface of at least one of said bearings, or combinations thereof based on a position of said outer bearing surface of at least one of said bearings relative to I) said inductor, II) said quench chamber, or combinations thereof, said master controller designed to access a plurality of control values used to generate output signals for said power controller, said flow controller, or combinations thereof based on a rotational position of said crankshaft in said apparatus to control said hardening of said outer bearing surface of at least one of said bearings, said plurality of control values at least partially based on different rotational positions of said crankshaft relative to said inductor, said outlet orifices, or combinations thereof when said outer bearing surface of at least one of said bearings is heated, quenched, or combinations thereof, said crankshaft designed to rotate about said center axis a plurality of arcuate increments of less than 360° in said apparatus to cause different portions of said outer bearing surface of at least one of said bearings to be heated by said inductor, quenched by said quench fluid, or combinations thereof as said crankshaft is successively rotated for each of said arcuate increments, said master controller accessing said control values that are at least partially based on a particular arcuate increment of rotation of said crankshaft and then controlling 1) said power output level from said power controller that is used to heat a particular portion of said outer bearing surface of at least one of said bearings by said inductor and to create a particular heating profile for heating said particular portion of said outer bearing surface of said at least one bearing by said inductor, said power output level at least partially based on a particular rotational position of said crankshaft in said apparatus, 2) said flow rate of said quench fluid onto a particular portion of said outer bearing surface of at least one of said bearings to create a particular quench profile for said particular portion of said outer surface of said at least one bearing, said flow rate is at least partially based on a particular rotational position of said crankshaft in said apparatus, or combinations thereof.

2. The apparatus as defined in claim 1, wherein said inductor encircles substantially less than 180 degrees of said outer bearing surface of at least one of said bearings when said crankshaft is positioned in said apparatus.

3. The apparatus as defined in claim 1, wherein said master controller generates output signals for controlling said flow controller based on each arcuate increment of rotation of said crankshaft in said apparatus, said master controller accessing at least one of said control values that correspond to a particular arcuate increment of rotation of said crankshaft in said apparatus and using such accessed control values to customize a flow rate of said quench fluid on a particular portion of said outer bearing surface of at least one of said bearings.

4. The apparatus as defined in claim 3, wherein each of said arcuate increments of rotation of said crankshaft is less than about 30 degrees.

5. The apparatus as defined in claim 4, wherein each of said arcuate increments of rotation of said crankshaft is about 10 degrees.

6. The apparatus as defined in claim 1, wherein the master controller has output signals for controlling said counterbalance of said inductor that correspond to a particular arcuate increment of rotation of said crankshaft in said apparatus.

7. The apparatus as defined in claim 6, wherein each of said arcuate increments of rotation of said crankshaft is less than about 30 degrees.

8. The apparatus as defined in claim 7, wherein each of said arcuate increments of rotation of said crankshaft is about 10 degrees.

9. The apparatus as defined in claim 1, wherein said counterbalancing mechanism includes a device for controlling said riding force to be in the general range of 15-30 pounds.

10. The apparatus as defined in claim 1, wherein each of said arcuate increments of rotation of said crankshaft is less than about 30 degrees.

11. The apparatus as defined in claim 1, wherein said flow controller producing at least two different flow rate profiles onto said outer bearing surface of at least one of said bearings during a complete quenching cycle, a first flow rate profile causing said quench fluid to continuously flow onto all of said outer bearing surface of said at least one bearing, a second flow rate profile occurring after said first flow rate profile, said second flow rate profile causing said quench fluid to have a non-continuous pulsed flow about a plurality of locations on said outer bearing surface of said at least one bearing.

12. The apparatus as defined in claim 11, wherein said flow controller discontinues said non-continuous pulsed flow of said quench fluid onto said outer bearing surface of said at least one bearing to leave sufficient internal heat in said at least one bearing for slight further tempering of said at least one bearing.

13. The apparatus as defined in claim 1, including a first and a second hardening station, said first hardening station including at least one of said inductors, said master controller controlling said first hardening station so as to cause said first hardening station to only harden said main bearings on said crankshaft, said second hardening station including at least one of said inductors, said first hardening station spaced from said second hardening station, said orbital bearings on said crankshaft including orbital bearings 1, 2, 3 and 4, said orbital bearings 2 and 3 positioned between said orbital bearings 1 and 4, at least one of said main bearings is positioned between said orbital bearings 1 and 4, said master controller controlling said second hardening station so as to cause said second hardening station to only harden one or more of said orbital bearings on said crankshaft.

14. The apparatus as defined in claim 13, including a third hardening station, said third hardening station including at least one of said inductors, said master controller controlling said second hardening station and said third hardening station so as to cause said second hardening station to harden said orbital bearings 2 and 3 and to cause said third hardening station to harden said orbital bearings 1 and 4, said master controller causing said third hardening station to harden said orbital bearings 1 and 4 after said second hardening station has hardened said orbital bearings 2 and 3.

15. The apparatus as defined in claim 14, including a mechanism for determining or measuring a TIR (Total Indicator Run Out) of said crankshaft after said outer bearing surface of a plurality of said bearings have been first hardened in said first and second hardening stations, and further including a TIR circuit and an adjustment circuit, said TIR circuit for determining a relation of said determined or measured TIR and a desired value of said TIR, said adjustment circuit to adjust said power controller for hardening said orbital bearings 1 and 4 that have not previously been hardened in said third hardening station so as to move said determined or measured TIR toward said desired value of said TIR during hardening of said orbital bearings 1 and 4 so as to limit or eliminate a need for post hardening straightening of said crankshaft after said outer bearing surface of said main bearings and said orbital bearings 1, 2, 3, 4 have been hardened.

16. The apparatus as defined in claim 15, wherein said desired value of said TIR (Total Indicator Run Out) is less than 0.015 inch.

17. The apparatus as defined in claim 1, wherein said master controller including a memory device with a data table, said data table containing a series of said control values used to generate output signals for said power controller to control said power output level when heating said outer bearing surface of at least one of said bearings, said data table indexed to a plurality of said arcuate increments of rotation of said crankshaft about said center axis, said series of signals at least partially defining said heating profile for at least one of said bearings, said data table including control values that correspond a plurality of said arcuate increments of rotation of said crankshaft in said apparatus.

18. The apparatus as defined in claim 17, including a device for changing said heating profile based upon a final tempered hardness of said outer bearing surface of at least one of said bearings during said heating of said outer bearing surface of at least one of said bearings.

19. An apparatus for hardening surfaces of a crankshaft for an internal combustion engine rotatable about a center axis wherein the crankshaft has a plurality of bearings that include a plurality of main bearings and orbital bearings and wherein the main bearings are concentrically oriented on said center axis of said crankshaft and wherein the orbital bearings are offset to said center axis of said crankshaft and wherein at least one of said main bearings is positioned between at least two of said orbital bearings and wherein said orbital bearings and said main bearings each having an outer bearing surface, said apparatus including first and second hardening stations, a movement mechanism to move said crankshaft from said first hardening station to said second hardening station and a master controller, said first hardening station including at least one inductor for induction heating said outer bearing surface of at least one of said main bearings and a quench system for quench hardening said heated outer bearing surface of said at least one main bearing, said second hardening station including at least one inductor for induction heating said outer bearing surface of at least one of said orbital bearings and a quench system for quench hardening said heated outer bearing surface of said at least one orbital bearing, said master controller causing said first hardening station to only harden said outer bearing surface of said main bearings when said crankshaft is positioned in said first hardening station, said master controller causing said second hardening station to only harden at least one of said outer bearing surface of said orbital bearings when said crankshaft is positioned in said second hardening station, said master controller causing said movement mechanism to move said crankshaft from said first hardening station to said second hardening station after said hardening of all of said outer bearing surface of said main bearings in said first hardening station.

20. The apparatus as defined in claim 19, wherein said orbital bearings includes orbital bearings 1, 2, 3 and 4, said orbital bearings 2 and 3 positioned between said orbital bearings 1 and 4, at least one of said main bearings positioned between said orbital bearings 1 and 4, and further including a third hardening station, said third hardening station including at least one inductor for induction heating at least one of said outer bearing surface of at least one of said orbital bearings and a quench system for quench hardening said heated outer bearing surface of said at least one orbital bearing, said master controller causing said second hardening station to harden said outer bearing surface of said orbital bearings 2 and 3, said master controller causing said third hardening station to harden said outer bearing surface of said orbital bearings 1 and 4, said master controller causing said second hardening station to harden said outer bearing surface of said orbital bearings 2 and 3 prior to said third hardening station hardening said outer bearing surface of said orbital bearings 1 and 4.

21. The apparatus as defined in claim 20, including a mechanism for determining or measuring a TIR (Total Indicator Run Out) of said crankshaft after said outer bearing surface of a plurality of said bearings have been first hardened in said first and second hardening stations, and further including a TIR circuit and an adjustment circuit, said TIR circuit for determining a relation of said determined or measured TIR and a desired value of said TIR, said adjustment circuit to adjust said power controller for hardening orbital bearings 1 and 4 that have not previously been hardened in said third hardening station so as to move said determined or measured TIR toward said desired value of said TIR during hardening of said orbital bearings 1 and 4 so as to limit or eliminate the need for post hardening straightening of said crankshaft after said outer bearing surface of said main bearings and said orbital bearings 1, 2, 3, 4 have been hardened.

22. The apparatus as defined in claim 21, wherein said desired value of said TIR (Total Indicator Run Out) is less than 0.015 inch.

23. The apparatus as defined in claim 21, wherein said master controller for creating output signals to control and change a) an output level from said power controller, b) a flow rate of quench fluid from a flow controller, or combinations thereof, said master controller creating i) a heating profile, ii) a quenching profile, or combinations thereof for a) heating at least a portion of said outer bearing surface of at least one of said bearings, b) quenching at least a portion of said outer bearing surface of at least one of said bearings, or combinations thereof based on a position of said outer bearing surface of at least one of said bearings relative to I) said inductor, II) said quench chamber, or combinations thereof, said master controller designed to access a plurality of control values used to generate output signals for said power controller, said flow controller, or combinations thereof based on a rotational position of said crankshaft in said apparatus to control said hardening of said outer bearing surface of at least one of said bearings to control said hardening of said outer bearing surface of at least one of said bearings, said plurality of control values at least partially based on different rotational positions of said crankshaft relative to said inductor, outlet orifices for quench fluid, or combinations thereof when said outer bearing surface of at least one of said bearings is heated, quenched, or combinations thereof, said crankshaft designed to rotate about said center axis a plurality of arcuate increments of less than 360° in said apparatus to cause different portions of said outer bearing surface of at least one of said bearings to be heated by said inductor, quenched by said quench fluid, or combinations thereof as said crankshaft is successively rotated for each of said arcuate increments, said master controller accessing said control values that are at least partially based on a particular arcuate increment of rotation of said crankshaft and then controlling 1) said power output level from said power controller that is used to heat a particular portion of said outer bearing surface of at least one of said bearings by said inductor and to create a particular heating profile for heating said particular portion of said outer bearing surface of at least one of said bearings by said inductor, said power output level is at least partially based on a particular rotational position of said crankshaft in said apparatus, 2) said flow rate of said quench fluid onto a particular portion of said outer bearing surface of at least one of said bearings to create a particular quench profile for said particular portion of said outer surface of at least one of said bearings, said flow rate is at least partially based on a particular rotational position of said crankshaft in said apparatus.

24. An apparatus for hardening surfaces of a crankshaft for an internal combustion engine rotatable about a center axis and wherein the crankshaft has a plurality of bearings that include a plurality of main bearings and a plurality of orbital bearings wherein the main bearings are concentrically oriented on said center axis of said crankshaft and wherein the orbital bearings are offset to said center axis of said crankshaft and wherein at least one of said main bearings is positioned between at least two of said orbital bearings and wherein the orbital bearings and said main bearings each having an outer bearing surface, said apparatus including an inductor to heat said outer bearing surface of at least one of said bearings, a quenching system that includes a quench head, a supply of quench fluid, a flow controller to direct flow with a given quantity of quench fluid to said quench head and against a heated outer bearing surface of at least one of said bearing and a quench controller creating a quench profile for controlling said flow controller so as to control said flow of quench fluid to said heated outer bearing surface of said at least one bearing during a quenching cycle, said crankshaft designed to rotate about said center axis a plurality of arcuate increments of less than 360° in said apparatus to cause different portions of said outer bearing surface of at least one of said bearings to be quenched by said quench fluid as said crankshaft is successively rotated for each of said arcuate increments, said quenching profile causing said flow controller to produce at least two different flow rate profiles onto said heated outer bearing surfaces to complete said quenching cycle, a first flow rate profile causing said quench fluid to continuously flow onto all of said heated outer bearing surface of said at least one bearing, a second flow rate profile occurring after said first flow rate profile, said second flow rate profile causing said quench fluid to have a non-continuous pulsed flow about a plurality of location on said outer bearing surface of said at least one bearing, said second flow rate profile for said non-continuous pulsed flow of said quench fluid is designed to discontinue flow of said quench fluid to said outer bearing surface of said at least one bearing to leave sufficient internal heat in said at least one bearing for slight further tempering of said at least one bearing.

25. The apparatus as defined in claim 24, wherein each of said arcuate increments of rotation of said crankshaft is less than about 30 degrees.

26. The apparatus as defined in claim 25, wherein each of said arcuate increments of rotation of said crankshaft is about 10 degrees.

27. An apparatus for hardening outer bearing surfaces of a plurality of bearings of a crankshaft for an internal combustion engine and wherein the crankshaft has a center axis and wherein the crankshaft has a plurality of bearings that include a plurality of main bearings and a plurality of orbital bearings and wherein the main bearings are concentrically oriented on said center axis of said crankshaft and wherein the orbital bearings are offset to said center axis of said crankshaft, and wherein at least one of said main bearings is positioned between said orbital bearings 1 and 4 and wherein at least one main bearing is positioned between said orbital bearings 1 and 4 having previously been hardened prior to hardening of said orbital bearings and wherein the orbital bearings and said main bearings each having an outer bearing surface, said apparatus including an inductor to harden said outer bearing surface of said orbital bearings, a mechanism for determining or measuring a TIR (Total Indicator Run Out) of said main bearings after said outer bearing surface of a first group of said orbital bearings on said crankshaft are hardened and prior to hardening said outer bearing surface of a second group of said orbital bearings, a TIR circuit for determining a relationship of said determined or measured TIR and a desired value of said TIR after said outer bearing surface of said first group of said orbital bearings has been hardened, and an adjustment circuit to adjust heating power to said inductor for hardening said outer bearing surface of said second group of said orbital bearings on said crankshaft to move said determined or measured TIR of said crankshaft toward said desired value of said TIR during said hardening of said outer bearing surface of said second group of orbital bearings so as to limit or eliminate a need for post hardening straightening of said crankshaft after said outer bearing surface of said second group of said orbital bearings have been hardened.

28. The apparatus as defined in claim 27, wherein said desired value of said TIR (Total Indicator Run Out) is less than 0.015 inch.

29. The apparatus as defined in claim 27, wherein said orbital bearings including orbital bearings 1, 2, 3 and 4, said orbital bearings 2 and 3 positioned between said orbital bearings 1 and 4, said first group of orbital bearings comprises said orbital bearings 2 and 3 and said second group of orbital bearings comprises said orbital bearings 1 and 4.

30. An apparatus for hardening the cylindrical outer bearing surface of a plurality of bearings on a crankshaft for an internal combustion engine, said apparatus comprising a heating profile with different induction heating power levels for said plurality of bearings on said crankshaft at a plurality of locations about said outer bearing surface of said plurality of bearings, an inductor for at least partially encircling said outer bearing surface of at least one of said bearings, a high frequency power source with a controller to implement said heating profile repeatedly during successive heating of said outer bearing surfaces of said plurality of bearings as said crankshaft is rotated about said center axis, a quench head for directing quench fluid against said outer bearing surface of said plurality of bearings after said outer bearing surface of said plurality of bearings are heated, and a flow controller for directing quench fluid through a quench head in a first continuous flow and subsequently in a pulsed flow to quench said heated outer bearing surface of said plurality of bearings, said crankshaft designed to rotate about said center axis a plurality of arcuate increments of less than 360° in said apparatus to cause different portions of said outer bearing surface of said plurality of bearings to be heated by said inductor, quenched by said quench fluid, or combinations thereof as said crankshaft is successively rotated for each of said arcuate increments, said heating profile for said outer bearing surface of said plurality of bearings causing a plurality of different power levels to be applied to said outer bearing surface of said plurality of bearings during said heating of different regions of said outer bearing surface of said plurality of bearings as said crankshaft is rotated about said central axis, said different power levels at least partially based on a particular arcuate increment of rotation of said crankshaft in said apparatus, said apparatus including a circuit to identify a particular location on said outer bearing surface of at least one of said bearings relative to said quench head and a flow controller for coordinating said pulsed flow based on said relative position of said outer bearing surface of at least one of said bearings relative to said quench head.

31. The apparatus as defined in claim 30, wherein said flow controller causes greater flow at top dead center of said outer bearing surface of at least one of said bearings than on other regions of said outer bearing surface of said at least one bearing.

32. The apparatus as defined in claim 30, wherein said heating profile has a higher power level at a bottom dead center of said outer bearing surface of at least one of said bearings than on other regions of said outer bearing surface of said at least one bearing.

33. An apparatus for hardening surfaces of a plurality of concentric main bearings and a plurality of orbital bearings of a crankshaft and wherein the main bearings concentrically are oriented on a center axis of said crankshaft and wherein the orbital bearings are offset to said center axis of said crankshaft and wherein the orbital bearings and said main bearings each having an outer bearing surface, said apparatus comprising an inductor, a high frequency power source, a flow controller, a quench chamber, a counterbalancing mechanism, and a master controller, said crankshaft designed to rotate about said center axis at a plurality of arcuate increments of less than 360° in said apparatus to cause different portions of said outer bearing surface of at least one of said bearings to be heated by said inductor, quenched by said quench fluid, or combinations thereof as said crankshaft is successively rotated for each of said arcuate increments, said inductor designed to encircle only a portion of said outer surface of at least one of said bearings to be hardened on said crankshaft, said inductor including a riding portion to engage at least a portion of said outer bearing surface of at least one of said bearings to be hardened on said crankshaft while said outer bearing surface is being hardened by said inductor, said riding portion causing an induction coil in said inductor to be spaced from at least a portion of said outer bearing surface to be hardened on said crankshaft while at least a portion of said outer bearing surface is being hardened by said inductor, said inductor connected to said high frequency power source, said high frequency power source connected to a power controller to cause said power source to direct power to said inductor, said quench chamber including outlet orifices directed toward at least a portion of said outer bearing surface of at least one of said bearings of said crankshaft, said flow controller controlling a quantity of quench fluid to said quench chamber to cause said quench fluid to flow through said orifices and against at least a portion of said outer bearing surface of at least one of said bearings of said crankshaft after said outer bearing surface has been heated by said inductor, said flow controller causing said quench fluid to contact said outer bearing surface of at least one of said bearings on said crankshaft, said counterbalancing mechanism including a counterbalance controller for controlling a riding force of said inductor against said outer bearing surface that is at least partially encircled by said inductor, said master controller creating output signals to control and change an output level of said power controller for heating said outer bearing surface of at least one of said bearings that is at least partially encircled by said inductor, said master controller creating output signals to control and change a flow rate of quench fluid from said flow controller to control a rate of quenching of said heated outer bearing surface of at least one of said bearings, said master controller creating a heating profile and a quenching profile, said heating profile used to control heating of a particular portion of said outer bearing surface of at least one of said bearings by said inductor based on a particular rotational position of said crankshaft in said apparatus, said quenching profile used to control a quenching rate of a particular portion of said heated outer bearing surface of at least one of said bearings based on a particular rotational position of said crankshaft in said apparatus, said master controller designed to access a plurality of control values used to generate output signals for said power controller and said flow controller to control said heating and quenching of said outer bearing surface of at least one of said bearings as said crankshaft rotates in said apparatus, said plurality of control values at least partially based on said rotational position of said crankshaft in said apparatus, said master controller accessing said control values that are at least partially based on a particular arcuate increment of rotation of said crankshaft and then controlling said power output level from said power controller that is used to heat a particular portion of said outer bearing surface of at least one of said bearings by said inductor to create a particular heating profile for heating said particular portion of said outer bearing surface of said at least one bearing based at least partially on said rotational position of said crankshaft in said apparatus, said master controller accessing said control values and then controlling said flow rate of said quench fluid onto a particular portion of said outer bearing surface of at least one of said bearings to created a particular quench profile of said particular portion of said outer surface of said at least one bearing based at least partially on said rotational position of said crankshaft in said apparatus.

34. The apparatus as defined in claim 33, including first and second hardening stations, said first hardening station having a plurality of inductors, said master controller causing each of said inductors in said first hardening station to only heat said outer bearing surface of said main bearings on said crankshaft, said second hardening station having a plurality of inductors, said master controller causing each of said inductors in said second hardening station to only heat said outer bearing surface of one or more of said orbital bearings on said crankshaft.

35. The apparatus as defined in claim 34, including a third hardening station, said third hardening station having a plurality of inductors, said master controller causing each of said inductors in said third hardening station to only heat said outer bearing surface of a plurality of said orbital bearings on said crankshaft, said orbital bearings including orbital bearings 1, 2, 3 and 4, said orbital bearings 2 and 3 positioned between orbital bearings 1 and 4, said master controller causing said second hardening station to heat said orbital bearings 2 and 3, said master controller causing said third hardening station to heat said orbital bearings 1 and 4 after said orbital bearings 2 and 3 have been hardened in said second hardening station.

36. The apparatus as defined in claim 35, including i) a mechanism for determining or measuring a TIR (Total Indicator Run Out) of said crankshaft after said first hardening station has heated and hardened all of said main bearings and said second hardening station has heated and hardened at least one of said orbital bearings on said crankshaft, ii) a circuit for determining a relationship between said determined or measured TIR and a desired value of TIR prior to said heating of at least one of said orbital bearings in said third hardening station, and iii) a circuit to adjust said power controller for heating previously non-hardened orbital bearings in said third hardening station so as to maintain or move said measured TIR toward said desired value of said TIR during hardening of said orbital bearings in said third hardening station to limit or eliminate a need for post hardening straightening of said crankshaft after said outer bearing surface of said main bearings and said orbital bearings have been hardened.

37. The apparatus as defined in claim 36, including a memory device with a data table and a device for accessing said data table, said data table indexed to a plurality of said arcuate increments of rotation of said crankshaft about said center axis, said data table containing a series of control values that are used to generate output signals for heating power levels for heating said outer bearing surface of at least one of said bearings for each different said arcuate increment of rotation of said crankshaft, said series of signals at least partially defining a heating profile for said outer bearing surface of at least one of said bearings, said device for accessing said data table designed to obtain said control values that correspond a particular rotational position of said crankshaft in said apparatus so that a desired heating power level is applied to said outer said outer bearing surface of said at least one bearing.

38. The apparatus as defined in claim 37, wherein said master controller causes said first hardening station to harden all of said outer bearing surfaces of said main bearings prior to said second station hardening said outer bearing surfaces of orbital bearings.

39. The apparatus as defined in claim 38, wherein said flow controller causing said quench fluid to pulse onto said outer bearing surface of at least one of said main bearings and at least one of said orbital bearings and then cause termination of flow of said quench fluid to said at least one main bearing and said at least one orbital bearing so that said at least one main bearing and said at least one orbital bearing has sufficient internal heat for slight tempering of said hardened surface of said at least one main bearing and said at least one orbital bearing.

40. The apparatus as defined in claim 39, wherein said flow controller causing said quench fluid to continuously flow onto said outer beating surface of at least one of said bearings for at least 360 degrees rotation of said crankshaft prior to said flow controller causing said pulsing of said quench fluid onto said outer bearing surface of said at least one main bearings and said outer surface of said at least one orbital bearing.

41. The apparatus as defined in claim 40, wherein said flow controller causes greater flow at a top dead center of said outer bearing surface of at least one of said orbital bearings than on other regions of said outer bearing surface of said orbital bearing.

42. The apparatus as defined in claim 41, wherein said heating profile has a higher power level at bottom dead center of said outer bearing surface of at least one of said orbital bearings than on other regions of said outer bearing surface said orbital bearing.

43. The apparatus as defined in claim 42, wherein the master controller accessing said control values and then controlling said counterbalance of said inductor based on each arcuate increment of rotation of said crankshaft in said apparatus.

44. The apparatus as defined in claim 34, wherein said master controller causes said first hardening station to harden all of said outer bearing surfaces of said main bearings prior to said second station hardening said outer bearing surfaces of orbital bearings.

45. The apparatus as defined in claim 33, including a memory device with a data table and a device for accessing said data table, said data table indexed to a plurality of said arcuate increments of rotation of said crankshaft about said center axis, said data table containing a series of control values that are used to generate output signals for heating power levels for heating said outer bearing surface of at least one of said bearings for each different said arcuate increment of rotation of said crankshaft, said series of signals at least partially defining a heating profile for said outer bearing surface of at least one of said bearings, said device for accessing said data table designed to obtain said control values that correspond a particular rotational position of said crankshaft in said apparatus so that a desired heating power level is applied to said outer said outer bearing surface of said at least one bearing.

46. The apparatus as defined in claim 45, wherein said heating profile has a higher power level at bottom dead center of said outer bearing surface of at least one of said orbital bearings than on other regions of said outer bearing surface said orbital bearing.

47. The apparatus as defined in claim 33, wherein said flow controller causing said quench fluid to pulse onto said outer bearing surface of at least one of said main bearings and at least one of said orbital bearings and then cause termination of flow of said quench fluid to said at least one main bearing and said at least one orbital bearing so that said at least one main bearing and said at least one orbital bearing has sufficient internal heat for slight tempering of said hardened surface of said at least one main bearing and said at least one orbital bearing.

48. The apparatus as defined in claim 47, wherein said flow controller causing said quench fluid to continuously flow onto said outer beating surface of at least one of said bearings for at least 360 degrees rotation of said crankshaft prior to said flow controller causing said pulsing of said quench fluid onto said outer bearing surface of said at least one main bearings and said outer surface of said at least one orbital bearing.

49. The apparatus as defined in claim 33, wherein said flow controller causes greater flow at a top dead center of said outer bearing surface of at least one of said orbital bearings than on other regions of said outer bearing surface of said orbital bearing.

50. The apparatus as defined in claim 33, wherein the master controller accessing said control values and then controlling said counterbalance of said inductor based on each arcuate increment of rotation of said crankshaft in said apparatus.

* * * * *